US011030947B2

(12) United States Patent
Takahashi

(10) Patent No.: US 11,030,947 B2
(45) Date of Patent: Jun. 8, 2021

(54) DISPLAY DEVICE EQUIPPED WITH POSITION DETECTING DEVICE FOR DETECTING POSITIONS OF PIXELS SUBJECTED TO LUMINANCE CALIBRATION

(71) Applicant: NEC Display Solutions, Ltd., Tokyo (JP)

(72) Inventor: Ryoji Takahashi, Tokyo (JP)

(73) Assignee: SHARP NEC DISPLAY SOLUTIONS, LTD., Tokyo (JP)

( * ) Notice: Subject to any disclaimer, the term of this patent is extended or adjusted under 35 U.S.C. 154(b) by 73 days.

(21) Appl. No.: 16/279,732

(22) Filed: Feb. 19, 2019

(65) Prior Publication Data

US 2019/0266940 A1 Aug. 29, 2019

(30) Foreign Application Priority Data

Feb. 27, 2018 (JP) ..... JP2018-033797

(51) Int. Cl.
*G09G 3/3225* (2016.01)
*G09G 3/00* (2006.01)

(52) U.S. Cl.
CPC ..... *G09G 3/3225* (2013.01); *G09G 3/006* (2013.01); *G09G 2320/0633* (2013.01); *G09G 2320/0693* (2013.01)

(58) Field of Classification Search
CPC ..... G09G 3/006; G09G 2320/0633; G09G 2320/0693; G09G 3/3225
See application file for complete search history.

(56) References Cited

U.S. PATENT DOCUMENTS

2012/0206349 A1* 8/2012 Nowatzyk ..... G06F 3/03545 345/158
2013/0016072 A1* 1/2013 Taylor ..... G06F 3/033 345/179
2016/0021346 A1* 1/2016 Liu ..... G06F 3/0317 348/744
2016/0247734 A1 8/2016 Fukushima et al.

FOREIGN PATENT DOCUMENTS

JP 2013-250420 A 12/2013
WO WO 2015/056365 A1 4/2015

* cited by examiner

*Primary Examiner* — Lixi C Simpson
(74) *Attorney, Agent, or Firm* — McGinn IP Law Group, PLLC

(57) ABSTRACT

A display device includes a display including a plurality of pixels having a plurality of light-emitting elements, a pixel selector configured to select a pixel from among a plurality of pixels, a positional information generator configured to generate the positional information representing the position of the selected pixel, and a light emission processor configured to superpose the positional information on the light emitted by the selected pixel. A position detecting device is used to detect and output the positional information superposed on the light of the selected pixel on the display device, thus making it easy to accurately detect the position of the pixel subjected to calibration in luminance.

10 Claims, 22 Drawing Sheets

| TYPE | HEADER |
|---|---|
| CABINET | 0xF0 |
| ROW | 0xF1 |
| COLUMN | 0xF2 |

DISPLAY DEVICE EQUIPPED WITH POSITION DETECTING DEVICE FOR DETECTING POSITIONS OF PIXELS SUBJECTED TO LUMINANCE CALIBRATION

CROSS-REFERENCE TO RELATED APPLICATION

The present application claims the priority benefit of Japanese Patent Application No. 2018-33797 filed on Feb. 27, 2018, the subject matter of which is hereby incorporated herein by reference.

BACKGROUND OF THE INVENTION

1. Field of the Invention

The present invention generally relates to a display device including a plurality of pixels using a plurality of light-emitting elements, in particular, to a position detecting device for detecting positions of pixels subjected to luminance calibration.

2. Description of Related Art

In general, a calibration process for an LED (Light Emitting Diode) display is carried out using a camera for taking an image of an entire screen, which is analyzed to adjust luminance at RGB pixels of an LED display. In this connection, for example, Patent Literature Document 1 discloses an inspection method of inspecting luminance unevenness of an organic electroluminescence display device using a high-resolution imaging device for detecting pixel luminance and a low-resolution imaging device for detecting surface luminance. Patent Literature Document 2 discloses an inspection device for inspecting luminance unevenness of an organic electroluminescence device by appropriately adjusting the position of an imaging device relative to an organic electroluminescence panel.

The aforementioned technologies need to take an image of an entire screen using an imaging device (e.g. a camera). However, it is difficult to apply those technologies to an inspection process of an LED display since it is difficult to set up a layout of an imaging device to capture an image of an entire screen of an LED display. Occasionally, it is necessary to repair defective pixels of an LED display, which was already set up in position, by changing defective light-emitting diodes. In this case, it is unnecessary to carry out a calibration method for adjusting luminance on an entire screen of an LED display. In other words, it would be more efficient to adopt another calibration method for adjusting luminance solely at the repaired pixels of an LED display.

CITATION OF PATENT LITERATURE DOCUMENTS

Patent Literature Document 1: Japanese Patent Application Publication No. 2013-250420

Patent Literature Document 2: International Publication No. WO2015/056365

SUMMARY OF THE INVENTION

According to the aforementioned method of adjusting luminance solely at the repaired pixels of an LED display, it is necessary to accurately detect the positions of the repaired pixels and to thereby adjust luminance at the detected positions. Due to recent advancement of LED displays using fine pitches among pixels, it is difficult for an inspector to accurately determine the positions of the pixels requiring repairs in their alignment at rows and columns (or ranks and files) by visually observing the exterior of a screen.

The present invention is made in consideration of the aforementioned circumstances, and therefore, the present invention aims to accurately and easily detect the positions of the pixels subjected to luminance calibration by way of visual observation on an exterior of a screen of a display device using a position detecting device.

In a first aspect of the invention, a display device includes a display including a plurality of pixels having a plurality of light-emitting elements; a pixel selector configured to select a pixel from among a plurality of pixels; a positional information generator configured to generate positional information representing a position of the pixel selected by the pixel selector; and a light emission processor configured to superpose the positional information on the light emitted by the pixel selected by the pixel selector.

In a second aspect of the invention, a position detecting device is adapted to a display device including a plurality of pixels having a plurality of light-emitting elements, in which the display device is configured to select a pixel from among a plurality of pixels and to thereby superpose the positional information of the selected pixel on the light emitted by the selected pixel. The position detecting device includes a photo-receiver configured to receive the light emitted by the selected pixel on the display device and to thereby covert the light into an electric signal; a positional information detector configured to detect the positional information superposed on the light of the selected pixel from the electric signal; and an output part configured to output the positional information detected by the positional information detector.

In a third aspect of the invention, a display calibration system includes a display device and a position detecting device. The display device further includes a display including a plurality of pixels having a plurality of light-emitting elements, a pixel selector configured to select a pixel from among a plurality of pixels, a positional information generator configured to generate positional information representing the position of the pixel selected by the pixel selector, and a light emission processor configured to superpose the positional information on the light emitted by the pixel selected by the pixel selector. The position detecting device includes a photo-receiver configured to receive the light emitted by the pixel on the display device and to thereby convert the light into an electric signal, a positional information detector configured to detect the positional information superposed on the light of the pixel from the electric signal, and an output part configured to output the positional information detected by the positional information detector.

In a fourth aspect of the invention, a display method is adapted to a display device including a plurality of pixels having a plurality of light-emitting elements. The display method includes the steps of: selecting a pixel from among a plurality of pixels on the display device; generating positional information representing the position of the selected pixel; and superposing the positional information on the light emitted by the selected pixel.

In a fifth aspect of the invention, a position detecting method is adapted to a display device including a plurality of pixels having a plurality of light-emitting elements in which the display device is configured to select a pixel from among a plurality of pixels and to thereby superpose the positional information of the selected pixel on the light emitted by the selected pixel. The position detecting method includes the steps of: receiving the light emitted by the selected pixel on the display device and to thereby covert the light into an electric signal; detecting the positional information superposed on the light of the selected pixel from the electric signal; and outputting the positional information.

In a sixth aspect of the invention, a display calibration method is adapted to a display calibration system comprising a display device and a position detecting device in which the display device includes a plurality of pixels having a plurality of light-emitting elements. The display calibration method includes the steps of: selecting, by the display device, a pixel from among the plurality of pixels; generating, by the display device, the positional information representing the position of the selected pixel; superposing, by the display device, the positional information on the light emitted by the selected pixel; receiving, by the position detecting device, the light emitted by the selected pixel on the display device and thereby converting the light into an electric signal; detecting the positional information superposed on the light of the selected pixel from the electric signal; and outputting the positional information.

According to the present invention, it is possible to easily and accurately detect a pixel selected from among a plurality of pixels on a display device using a position detecting device for the purpose of luminance calibration. That is, an operator who conducts calibrations on the display device may easily detect an accurate position of a pixel subjected to calibration by way of visual observation using the position detecting device applied to the display device.

BRIEF DESCRIPTION OF THE DRAWINGS

FIG. 9 shows an exterior appearance of the position detecting device shown in

FIG. 8.

DETAILED DESCRIPTION OF THE EMBODIMENTS

The present invention will be described in detail by way of embodiments and examples with reference to the accompanying drawings.

1. First Embodiment

Figure 1:
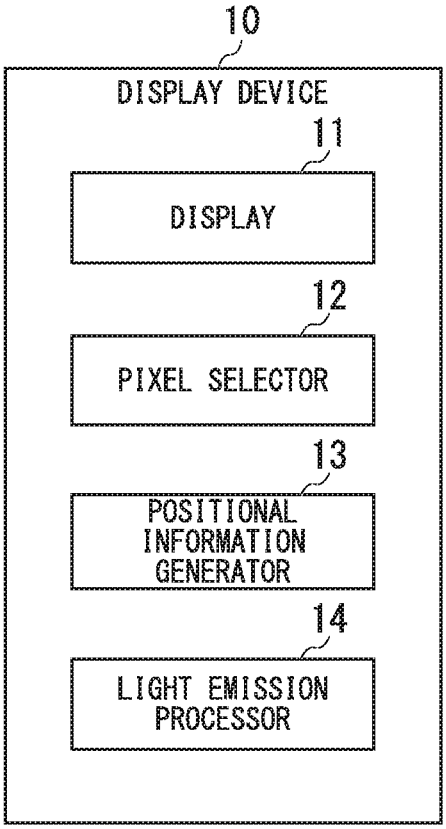
FIG. 1 is a block diagram of a display device according to the first embodiment of the present invention.

FIG. 1 is a block diagram of a display device 10 according to the first embodiment of the present invention. The display device 10 includes a display 11, a pixel selector 12, a positional information generator 13, and a light emission processor 14. The display 11 includes a plurality of pixels using a plurality of light-emitting elements. The pixel selector 12 is configured to select pixels to emit light. The positional information generator 13 generates positional information about the positions of the pixels selected by the pixel selector 12. The light emission processor 14 superposes the positional information generated by the positional information generator 13 on the light emitted by the pixels selected by the pixel selector 12 when emitting light at the selected pixels.

Figure 2:
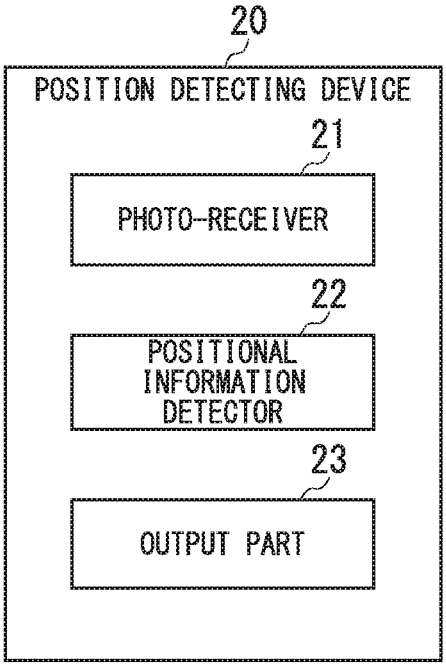
FIG. 2 is a block diagram of a position detecting device according to the first embodiment of the present invention.

FIG. 2 is a block diagram of a position detecting device 20 according to the first embodiment of the present invention. The position detecting device 20 includes a photo-receiver 21, a positional information detector 22, and an output part 23. The photo-receiver 21 receives light emitted by light-emitting elements at pixels of the display device 10 and thereby convert it into electric signals. The positional information detector 22 detects the positional information superposed on electric signals output from the photo-receiver 21. The output part 23 outputs the positional information detected by the positional information detector 22.

According to the first embodiment, it is possible to easily detect the positions of the pixels subjected to luminance calibration, which are determined by way of visual observation on the display device 10 including a plurality of pixels, using the position detecting device 20. In this connection, the first embodiment uses light-emitting diodes (LEDs) as light-emitting elements, however, it is possible to use other types of light-emitting elements.

2. Second Embodiment

Figure 3:
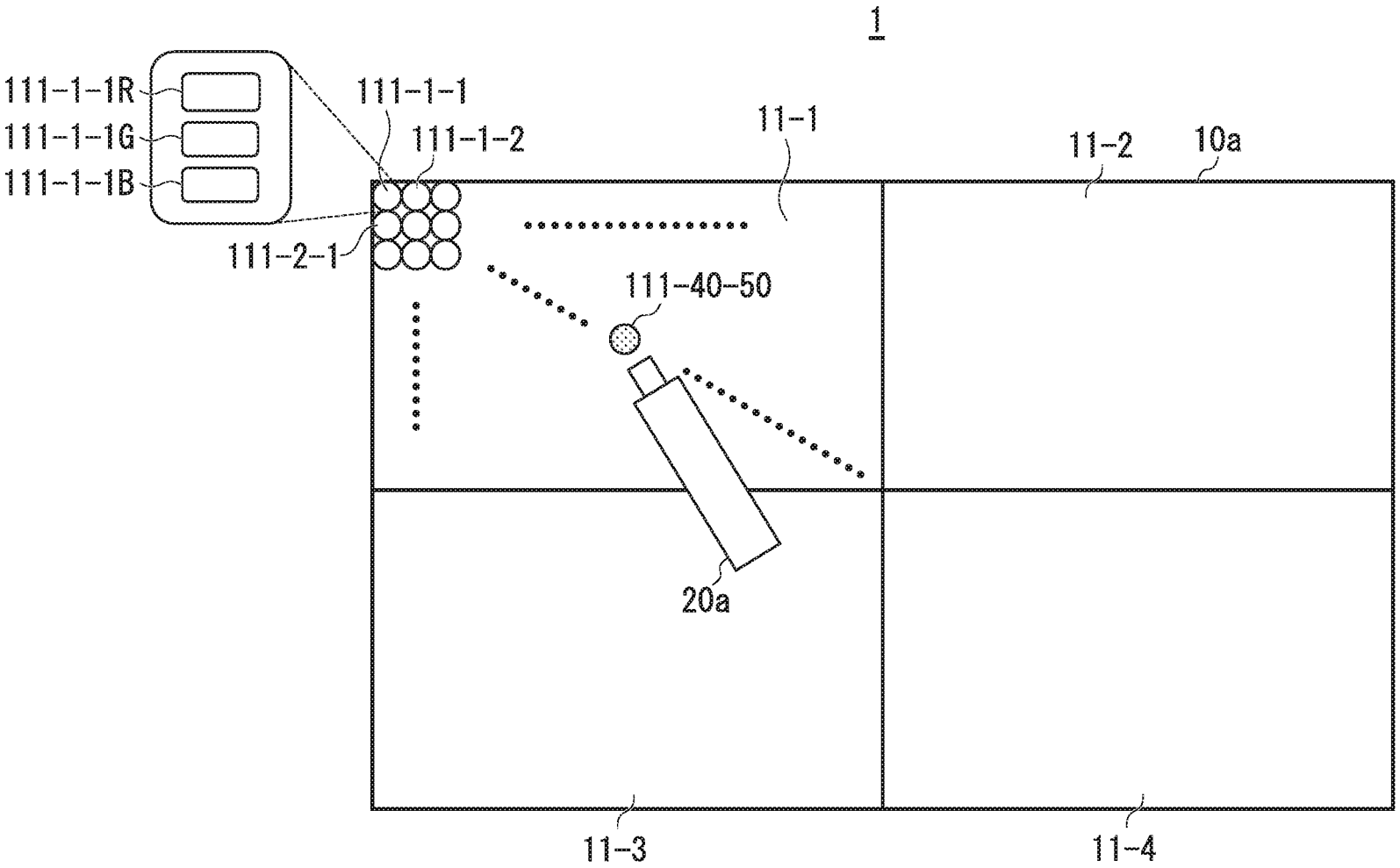
FIG. 3 is a schematic diagram of a display calibration system according to the second embodiment of the present invention.

FIG. 3 is a schematic diagram of a display calibration system 1 according to the second embodiment of the present invention. The display calibration system 1 includes a display device 10*a* and a position detecting device 20*a*.

Figure 4:
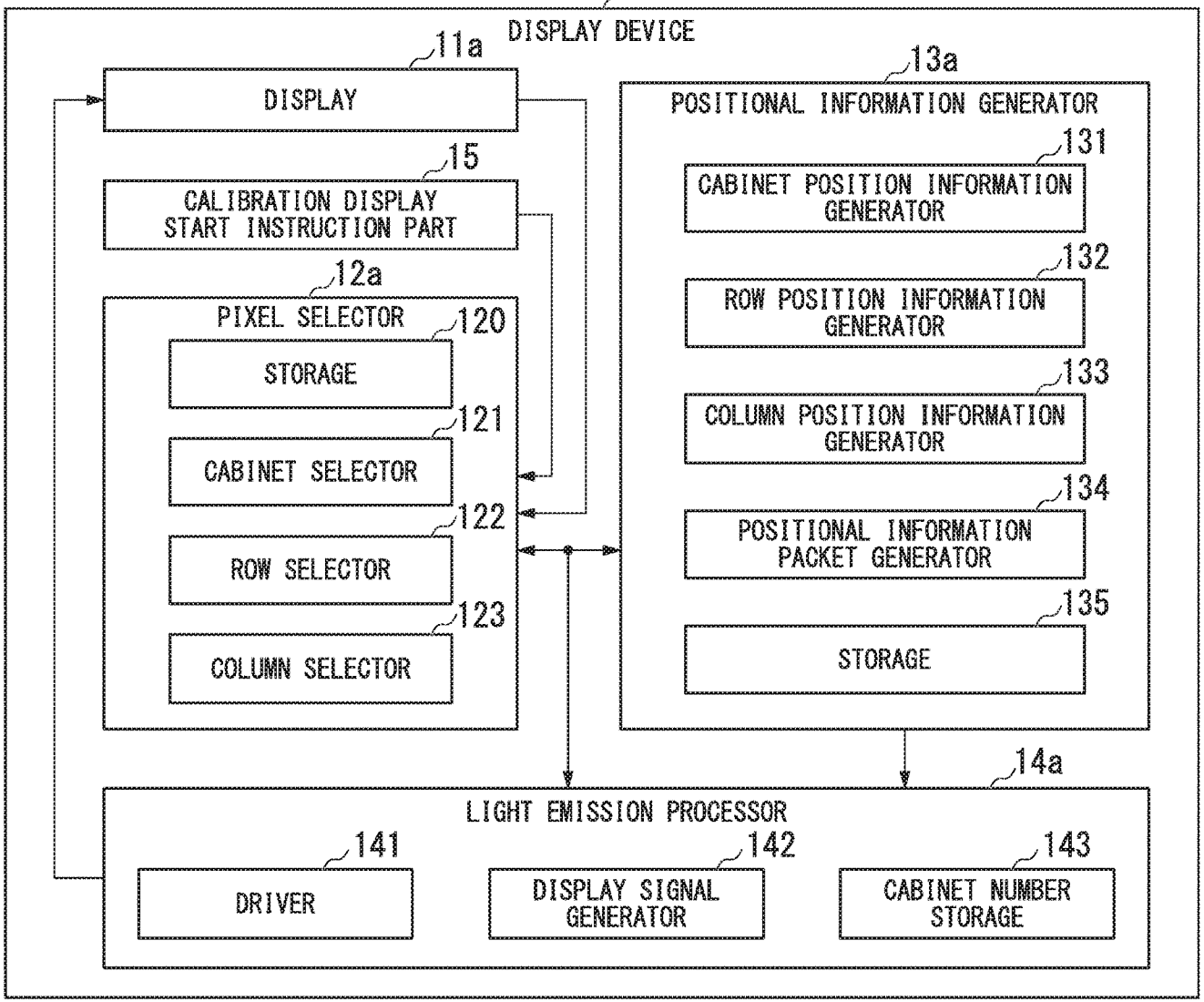
FIG. 4 is a block diagram of a display device included in the display calibration system shown in FIG. 3.

FIG. 4 is a block diagram of the display device 10*a* included in the display calibration system 1 shown in FIG. 3. The display device 10*a* includes a display 11*a*, a pixel selector 12*a*, a positional information generator 13*a*, a light emission processor 14*a*, and a calibration display start instruction part 15. As shown in FIG. 3, for example, the display 11*a* of the display device 10*a* includes four sections called cabinets. The number of cabinets is not necessarily limited to four; hence, the display 11*a* may include an arbitrary number of cabinets except for a single cabinet.

By incorporating an LED display into each cabinet, it is possible to form an entire screen of the display 11*a* like a single large-size LED display. For the sake of convenience, four cabinets of LED displays will be referred to as cabinet displays 11-1, 11-2, 11-3, and 11-4 as shown in FIG. 3.

Different cabinet numbers are assigned to the cabinet displays 11-1 through 11-4 in advance. For example, cabinet numbers "1", "2", "3", and "4" are assigned to the cabinet displays 11-1, 11-2, 11-3, and 11-4.

Each of the four cabinet displays 11-1 through 11-4 includes a plurality of pixels using LEDs, which are aligned in a matrix consisting of rows and columns (or ranks and files) counted in a direction from the upper left position to the lower right position. For example, the cabinet display 11-1 includes pixels 111-1-1, 111-1-2, . . . , 111-2-1, . . . . As to each pixel number assigned to the pixels of the cabinet display 11-1, the number "111" is followed by two branch numbers corresponding to rows and columns of a matrix such that the pixel number 111-2-1 includes a first branch number "2" indicating the second row and a second branch number "1" indicating a first column. For the sake of convenience, an arbitrary pixel included in the cabinet display 11-1 will be simply referred to as a pixel number "111" precluding its branch numbers.

Each pixel 111 includes three LEDs colored in red, green, and blue. As shown in FIG. 3, the pixel 111-1-1 includes a red LED 111-1-1R, a green LED 111-1-1G, and a blue LED 111-1-1B.

The pixel selector 12*a* includes a storage 120, a cabinet selector 121, a row selector 122, and a column selector 123. The storage 120 is configured to store the cabinet numbers assigned to the cabinet displays 11-1 through 11-4 and to store the rows and columns of the pixels included in each of the cabinet displays 11-1 through 11-4 in connection with the cabinet numbers.

The cabinet selector 121 selectively outputs the cabinet number, corresponding to any one of cabinet displays 11-1 through 11-4 subjected to cabinet display operations, with reference to the storage 120.

With reference to the storage 120, the row selector 122 sequentially selects rows subjected to calibration display operations from the first row to the last row within the range of rows correlated to the cabinet number output by the cabinet selector 121, thus outputting the row number of the selected row. With reference to the storage 120, the column selector 123 sequentially selects columns subjected to calibration display operations from the first column to the last column within the number of columns correlated to the cabinet number output by the cabinet selector 121, thus outputting the column number of the selected column.

The cabinet display operations are carried out with respect to the entire screens of the cabinet displays 11-1 through 11-4, rows of pixels and columns of pixels included in the cabinet displays 11-1 through 11-4 as described below.

The cabinet display operation for each cabinet display among the cabinet displays 11-1 through 1104 is carried out on the display 11*a* such that the positional information representing each cabinet display is superposed on a display signal for depicting the entire screen of each cabinet display in white.

The row-related cabinet display operation for each cabinet display among the cabinet displays 11-1 through 11-4 is carried out on the display 11*a* such that the positional information representing the row number relating to one row of pixels is superposed on a display signal for depicting one row of pixels in white in each cabinet display.

The column-related cabinet display operation for each cabinet display among the cabinet displays 11-1 through 11-4 is carried out on the display 11*a* such that the positional information representing the column number relating to one column of pixels in each cabinet display is superposed on a display signal for depicting in white one column of pixels in each cabinet display.

The positional information generator 13*a* includes a cabinet position information generator 131, a row position information generator 132, a column position information generator 133, a positional information packet generator 134, and a storage 135. The storage 135 is configured to store a table shown in FIG. 5. The table has two items, namely "type" and "header". The item "type" refers to any one of types among cabinets, rows, and columns, while the item "header" refers to hexadecimal header values assigned to types in advance.

The cabinet position information generator 131 inputs a cabinet number output from the cabinet selector 121 and thereby reads header information representing the "cabinet" type from the storage 135. In addition, the cabinet position information generator 131 converts the cabinet number in notation from a decimal number to a hexadecimal number so as to produce data information, and then, the cabinet position information generator 131 sends the header information and the data information to the positional information packet generator 134.

The row position information generator 132 inputs a row number output from the row selector 122 and thereby reads header information representing the "row" type from the storage 135. In addition, the row position information generator 132 converts the row number in notation from a decimal number to a hexadecimal number so as to produce data information, and then, the row information generator 132 sends the header information and the data information to the positional information packet generator 134.

The column position information generator 133 inputs a column number output from the column selector 123 and thereby reads header information representing the "column" type from the storage 135. In addition, the column position information generator 133 converts the column number in notation from a decimal number to a hexadecimal number so as to produce data information, and then, the column position information generator 133 sends the header information and the data information to the positional information packet generator 134.

The positional information packet generator 134 inputs a pair of the header information and the data information output from the cabinet position information generator 131, the row position information generator 132, or the column position information generator 133. The positional information packet generator 134 generates a packet having a data format shown in FIG. 6 based on the header information and the data information, wherein the data format of FIG. 6 includes a header section of 1 byte describing the header information and a data section of 2 bytes for describing the data information. The positional information packet generator 134 generates and sends the packet having the data format of FIG. 6 to the light emission processor 14*a*.

The light emission processor 14*a* includes a driver 141, a display signal generator 142, and a cabinet number storage 143. The driver 141 inputs a display signal generated and outputted by the display signal generator 142 and thereby flashes light on the entire screen of the cabinet displays 11-1 through 11-4, at rows or columns on screen.

Upon inputting the cabinet number output from the cabinet selector 121, the display signal generator 142 writes and stores the cabinet number on the cabinet number storage 143. In addition, the display signal generator 142 generates a display signal for depicting in white the entire screen of the cabinet displays 11-1 through 11-4.

Upon inputting the row number output from the row selector 122, the display signal generator 142 generates a display signal for depicting in white the row of pixels corresponding to the row number in the cabinet display 11 selected from among the cabinet displays 11-1 through 11-4 according to the cabinet number stored on the cabinet number storage 143. Upon inputting the column number output from the column selector 123, the display signal generator 142 generates a display signal for depicting in white the column of pixels corresponding to the column number in the cabinet display 11 selected from among the cabinet displays 11-1 through 11-4 according to the cabinet number stored on the cabinet number storage 143.

In this connection, the LED display can be adjusted in luminance by flashing LEDs at high speed by way of a PWM (Pulse Width Modulation) control operation. For this reason, the display signal generator 142 includes a first clock circuit for outputting a high-frequency clock signal and a second clock circuit for outputting a low-frequency clock signal. Accordingly, the display signal generator 142 generates a high-frequency display signal for a PWM control operation based on the high-frequency clock signal output from the first clock circuit.

Upon inputting packets output from the positional information packet generator 134, the display signal generator 142 generates information included in packets and a drive waveform including positional information according to the low-frequency clock signal output from the second clock circuit. In this connection, the low frequency of a clock signal output from the second clock circuit may have a certain frequency difference below the high frequency of a clock signal output from the first clock circuit such that the low-frequency clock signal can be separated from the high-frequency clock signal via a filtering process.

Figure 7:
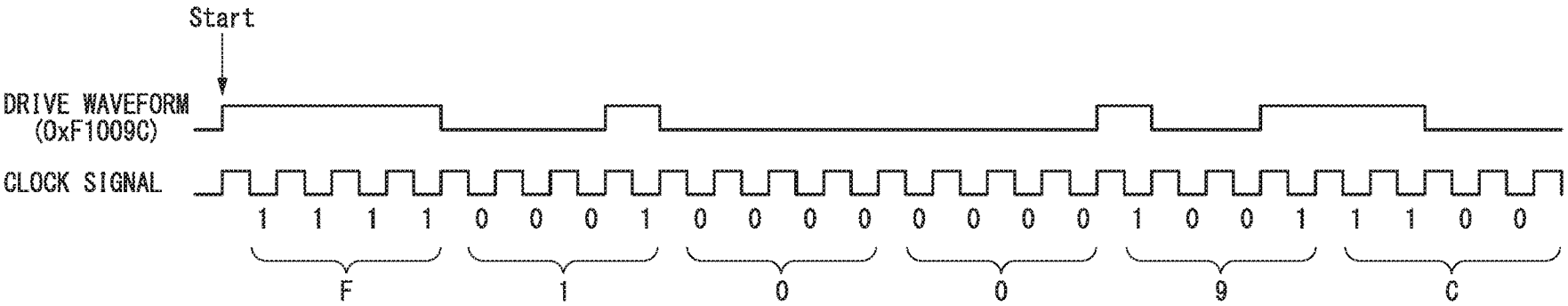
FIG. 7 shows a drive waveform in relation to a clock signal generated by the display device of FIG. 4.

For example, it is assumed that the positional information packet generator 134 may generate a packet representing "156th row", i.e. a packet including a header section of "0xF1" and a data section of "0x009C", wherein the display signal generator 142 generates a drive waveform corresponding to a timing chart of FIG. 7. The drive waveform of FIG. 7 is established to define data at a trailing-edge timing of a clock signal of the second clock circuit.

The display signal generator 142 superposes a drive waveform including the positional information corresponding to the cabinet number on a display signal for depicting the entire screen, which is generated based on the cabinet number, and therefore, the display signal generator 42 sends the display signal superposed with the drive waveform to the driver 141. By superposing the drive waveform on the display signal, it is possible to reshape the envelope of the display signal as the shape of the drive waveform. Accordingly, it is possible to reproduce the drive waveform by eliminating high-frequency flashing components from the drive signal through a low-pass filter.

The drive signal generator 142 superposes a drive waveform including the positional information corresponding to the row number on a display signal for depicting one line of pixels, which is generated based on the row number, and therefore, the drive signal generator 142 sends the display signal superposed with the drive waveform to the driver 141. In addition, the drive signal generator 142 superposes a drive waveform including the positional information corresponding to the column number on a display signal for depicting one column of pixels, which is generated based on the column number, and therefore, the drive signal generator 142 sends the display signal superposed with the drive waveform to the driver 141. The cabinet number storage 143 stores the cabinet number written into the drive signal generator 142.

Figure 8:
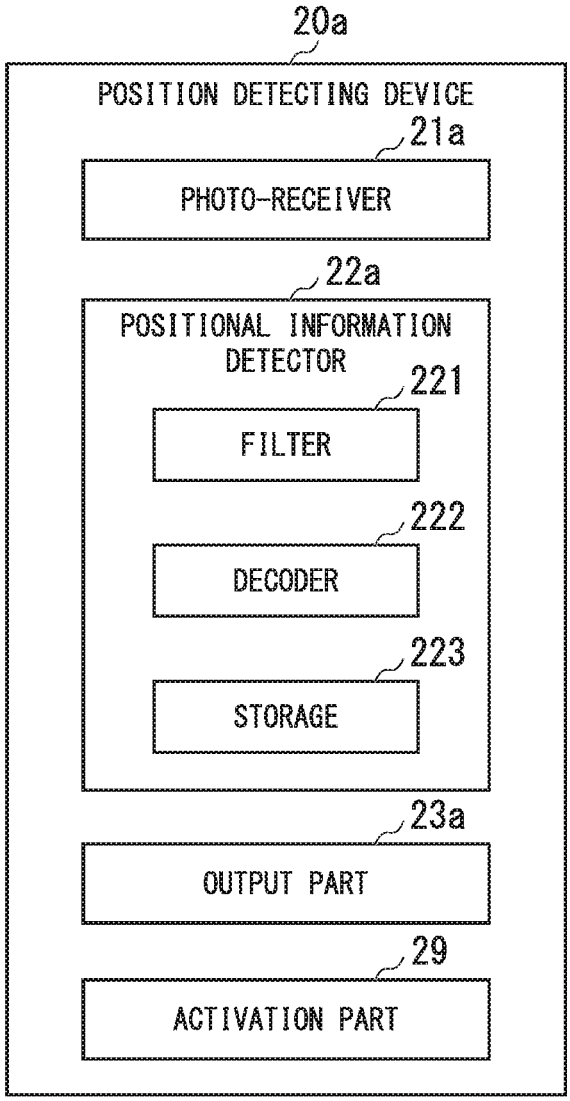
FIG. 8 is a block diagram of a position detecting device according to the second embodiment of the present invention.
Figure 9:
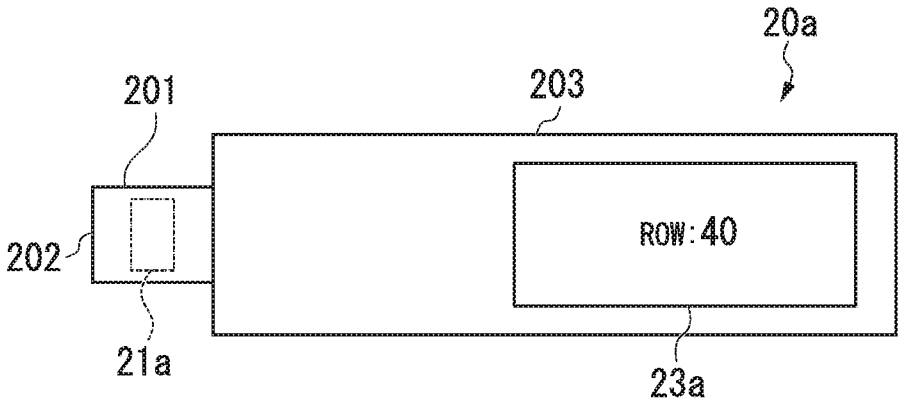

FIG. 8 shows the configuration of a position detecting device 20*a*, which includes a photo-receiver 21*a*, a positional information detector 22*a*, an output part 23*a*, and an activation part 29. FIG. 9 shows an example of an exterior appearance of the position detecting device 20*a* having a pen-like shape. An operator who intends to calibrate the display device 10*a* manipulates the position detecting device 20*a* by holding a main body 203 like holding a pen. To calibrate the luminance of a pixel 111-40-50, which is located at 40th row and 50th column of the cabinet display 11-1 as shown in FIG. 3, for example, an operator moves the position detecting device 20*a* towards the cabinet display 11-1 so as to cover the pixel 111-40-50 with its opening 202.

Figure 10:
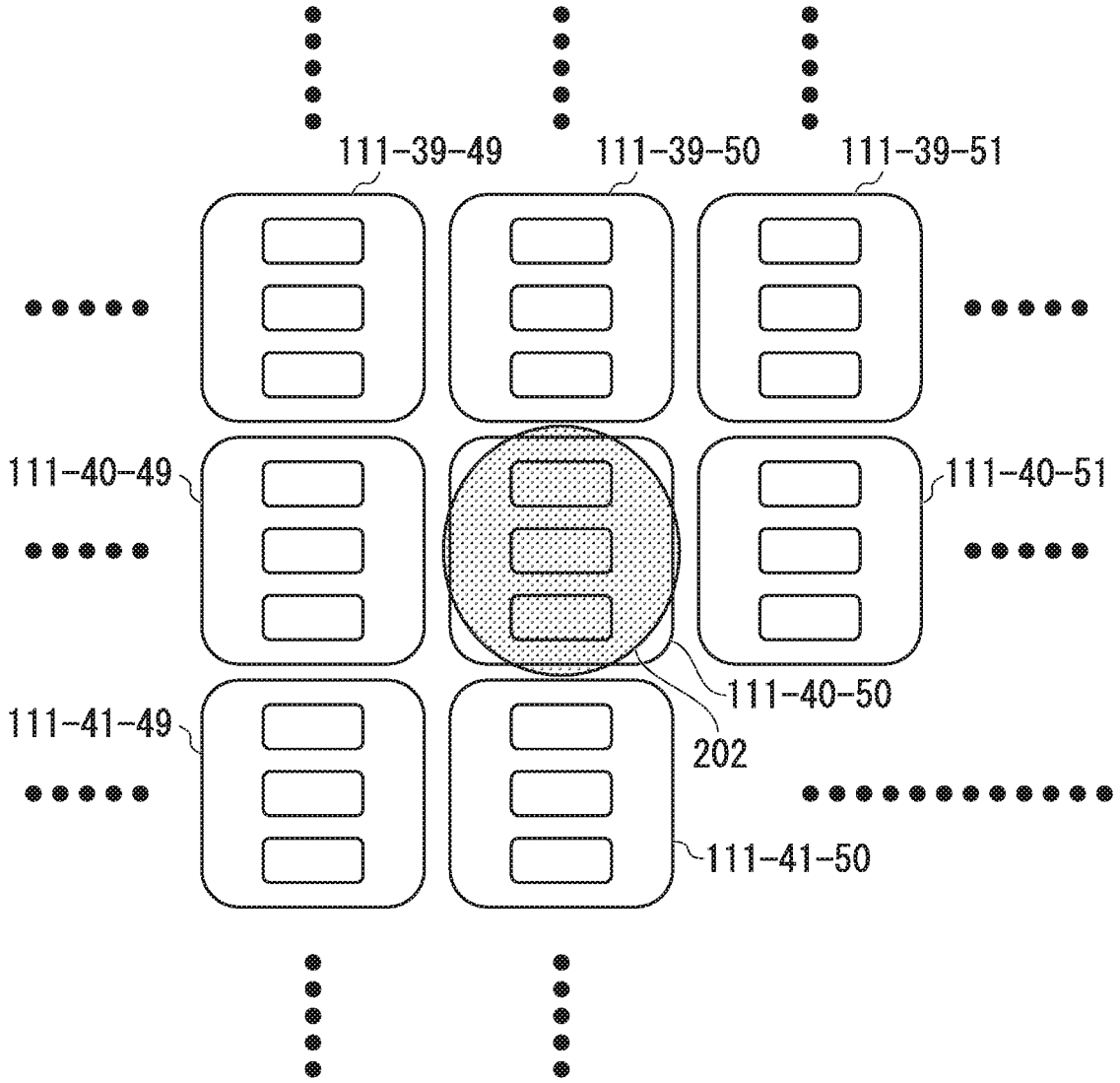
FIG. 10 shows the positional relationship between pixels and an opening of the position detecting device shown in FIG. 9.

As shown in FIG. 10, the opening 202 of the position detecting device 20*a* has a structure to solely receive light emitted from the pixel 111-40-50 subjected to calibration but to prevent receiving other light emitted from its adjacent pixels located in upper, lower, left, right, and slanted directions such as pixels 111-39-49, 111-39-50.

For example, the photo-receiver 21*a* of the position detecting device 20*a* is a photo-sensor, which is embedded inside a distal end portion 201 of the position detecting device 20*a* as shown in FIG. 9. The photo-receiver 21*a* receives light emitted from the pixel 111 through the opening 202 and thereby converts the received light into an electric signal, thus sending the electric signal to the positional information detector 22*a* shown in FIG. 8.

The positional information detector 22*a* includes a filter 221, a decoder 222, and a storage 223. The storage 223 stores the table of FIG. 5 in advance. The filter 221 carries out low-pass filtering for cutting out high-frequency components from the electric signal output from the photo-receiver 21*a*, and therefore, the filter 221 removes high-frequency flashing components, which is used for a PWM control operation, from the electric signal, thus producing a low-frequency drive waveform.

Figures 5, 6:
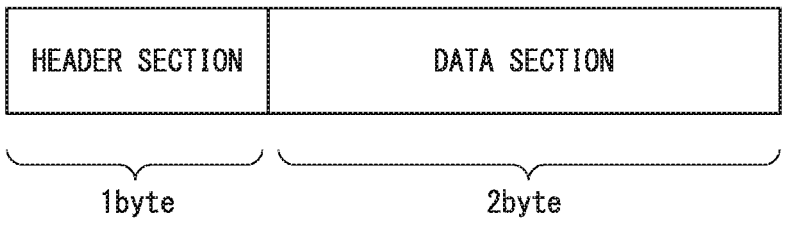
FIG. 5 shows a table representing the relationship between types and headers used in the display device shown in FIG. 4.
FIG. 6 shows a data format of a packet generated by the display device of FIG. 4.

The decoder 222 decodes the drive waveform output from the filter 221 into a hexadecimal number, from which the decoder 222 restores the information having the data format of FIG. 6, and then, the decoder 222 separates the restored information into a header section and a data section. With reference to the table stored on the storage 223, the decoder 222 retrieves the information type included in the header section such as "cabinet", "row", and "column" The decoder 222 converts the information described in the data section into a decimal number and thereby outputs the converted number as the positional information.

For example, the output part 23*a* has a screen of a liquid-crystal display, which is built in the main body 203 of the position detecting device 20*a* as shown in FIG. 9. The output part 23*a* displays the information type and the positional information output from the decoder 222. The activation part 29 includes a switch. Upon turning on the switch, the activation part 29 starts the processing of other functional parts in the position detecting device 20*a*. Upon turning off the switch, the activation part 29 stops the processing of other functional parts of the position detecting device 20*a*.

Figure 11:
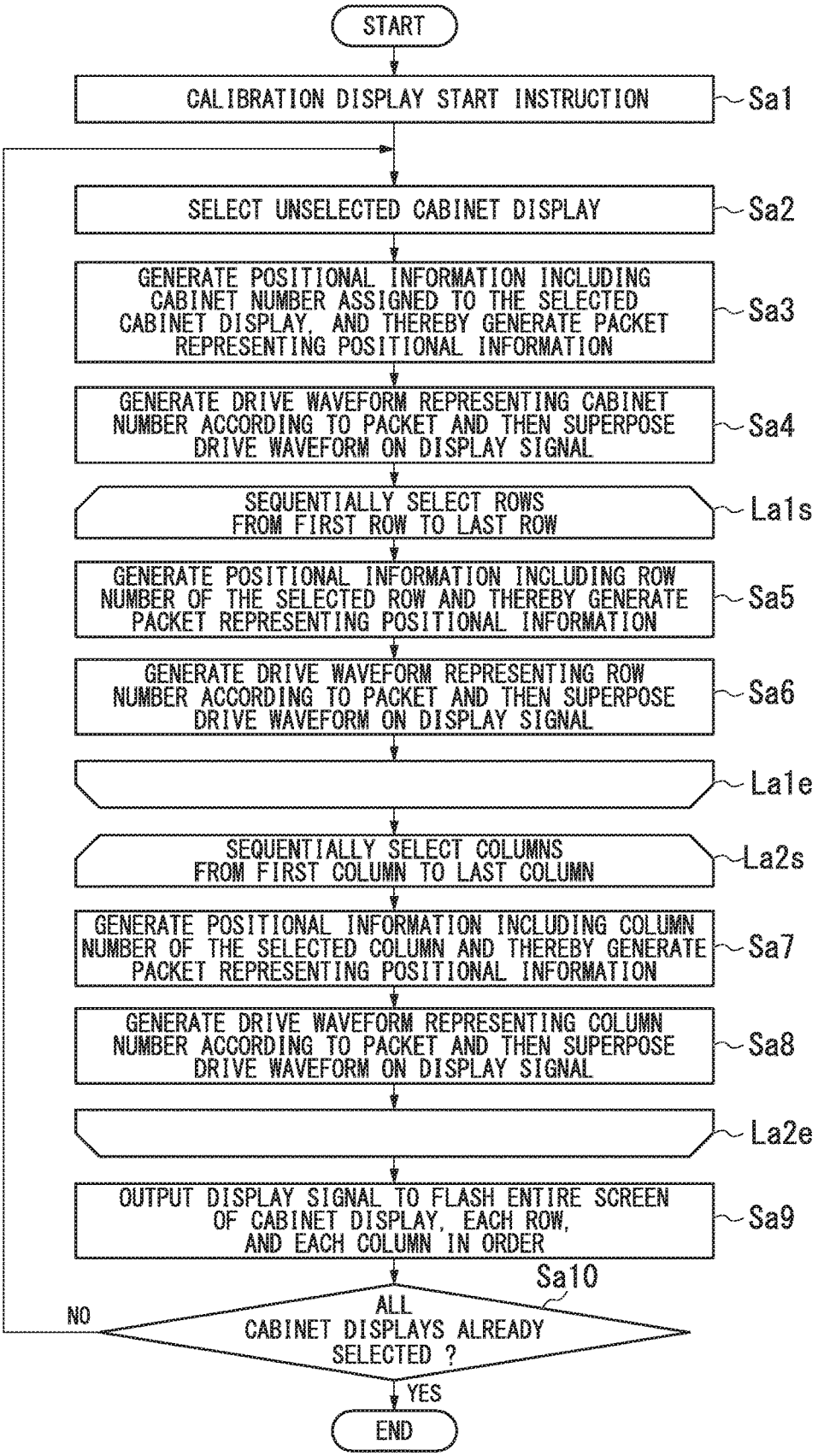
FIG. 11 is a flowchart showing a series of processes implemented by the display device of the second embodiment.

FIG. 11 is a flowchart showing a series of processes implemented by the display device 10*a* according to the second embodiment. For example, an operator who intends to calibrate the display device 10*a* presses a button installed in the display device 10*a*, and therefore, the calibration display start instruction part 15 sends a calibration display start instruction to the pixel selector 12*a* in step Sa1.

Upon receiving the calibration display start instruction, the cabinet selector 121 of the pixel selector 12*a* selects a single "unselected" cabinet display from among the cabinet displays 11-1 through 11-4 in step Sa2. In the case that the display device 10*a* proceeds to step Sa2 at first, it can be said that all the cabinet displays 11-1 through 11-4 have not been selected yet. For the sake of simplifying the following description, it is assumed that the cabinet selector 121 would select the cabinet display 11-1 at first.

The cabinet selector 121 reads "1" representing the cabinet number assigned to the selected cabinet display 11-1 from the storage 120, and therefore, the cabinet selector 121 sends the cabinet number "1" to the row selector 122, the column selector 123, the positional information generator 13*a*, and the light emission processor 14*a*. Upon inputting the cabinet number "1" output from the cabinet selector 121, the cabinet position information generator 131 of the positional information generator 13*a* converts the cabinet number from its decimal number "1" to a hexadecimal number "0x0001".

The cabinet position information generator 131 reads a header "0xF0" corresponding to the cabinet type from the table stored on the storage 135, and therefore the cabinet position information generator 131 provides the positional information packet generator 134 with the header and the cabinet number, i.e. the converted hexadecimal number "0x0001".

The positional information packet generator 134 generates a packet "0xF00001" having the data format of FIG. 6 based on the header information and the data information output from the cabinet position information generator 131. The positional information packet generator 134 sends the packet to the light emission processor 14*a* in step Sa3.

Upon inputting the cabinet number "1" output from the cabinet selector 121, the display signal generator 142 of the light emission processor 14*a* writes and stores the cabinet number "1" on the cabinet number storage 143. The display signal generator 142 generates a display signal for depicting in white the entire screen of the cabinet display 11-1 corresponding to the cabinet number.

Upon inputting the packet output from the positional information packet generator 134, the display signal generator 142 generates a drive waveform including the positional information of the cabinet number "1" based on the packet. The display signal generator 142 superposes the drive waveform on the display signal for depicting in white the entire screen of the cabinet display 11-1, and therefore, the display signal generator 142 sends the display signal superposed with the drive waveform to the driver 141 in step Sa4.

With reference to the storage 120, the row selector 122 sequentially selects rows from a first row to a last row within a range of rows correlated to the cabinet number "1" output from the cabinet selector 121. The row selector 122 sends the row number of the selected row to the positional information generator 13*a* and the light emission processor 14*a*. The row position information generator 132 of the positional information generator 13*a* inputs the row number output from the row selector 122 and then converts the row number from a decimal number to a hexadecimal number.

The row position information generator 132 reads a header "0xF1" corresponding to the row type from the table of the storage 135, and then, the row position information generator 132 sends the header and the row number, which is converted into a hexadecimal number, to the positional information packet generator 134.

The positional information packet generator 134 generates a packet having the data format of FIG. 6 based on the header information and the data information output from the row position information generator 132. The positional information packet generator 134 sends the packet to the light emission processor 14*a* in step Sa5.

Upon inputting the row number output from the row selector 122, the display signal generator 142 of the light emission processor 14*a* reads the cabinet number stored on the cabinet number storage 143. At this time, the cabinet number storage 143 stores the cabinet number "1". Accordingly, the display signal generator 142 reads the cabinet number "1" from the cabinet number storage 143 and thereby generates a display signal for depicting in white a row of pixels, corresponding to the row number in the cabinet display 11-1 corresponding to the cabinet number "1".

Upon inputting the packet output from the positional information packet generator 134, the display signal generator 142 generates a drive waveform including the positional information of the row number based on the packet. The display signal generator 142 superposes the drive waveform on the display signal and thereby sends the drive signal, which is superposed with the drive waveform, to the driver 141 in step Sa6.

The row selector 122, the row position information generator 132, the positional information packet generator 134, and the display signal generator 142 cooperate together to repeatedly carry out a series of steps Sa5-Sa6 from the first row to the last row in a loop La1*s*-La1*e*.

With reference to the storage 120, the column selector 123 sequentially selects columns from a first column to a last column within a range of columns correlated to the cabinet number "1" output from the cabinet selector 121. The column selector 123 sends the column number of the selected column to the positional information generator 13*a* and the light emission processor 14*a*. Upon inputting the column number output from the column selector 123, the column position information generator 133 of the positional information generator 13*a* converts the column number from a decimal number to a hexadecimal number.

The column position information generator 133 reads a header "0xF2" corresponding to the column type from the table of the storage 135, and then, the column position information generator 133 sends the header and the column number, which is converted into a hexadecimal number, to the positional information packet generator 134.

The positional information packet generator 134 generates a packet having the data format of FIG. 6 based on the header information and the data information output from the column position information generator 133. The positional information packet generator 134 sends the packet to the light emission processor 14*a* in step Sa1.

Upon inputting the column number output from the column selector 123, the display signal generator 142 of the light emission processor 14*a* reads the cabinet number stored on the cabinet number storage 143. At this time, the cabinet number storage 143 stores the cabinet number "1". Accordingly, the display signal generator 142 reads the cabinet number "1" from the cabinet number storage 143 and thereby generates a display signal for depicting in white a column of pixels corresponding to the column number in the cabinet display 11-1 corresponding to the cabinet number "1".

Upon inputting the packet output from the positional information packet generator 134, the display signal generator 142 generates a drive waveform including the positional information of the column number based on the packet. The display signal generator 142 superposes the drive waveform on the display signal and thereby sends the display signal superposed with the drive waveform to the driver 141 in step Sa8.

The column selector 123, the column position information generator 133, the positional information packet generator 134, and the display signal generator 142 cooperate together to repeatedly carry out a series of steps Sa1-Sa8 in a loop La2*s*-La2*e*.

Upon inputting the display signal superposed with the drive waveform output from the display signal generator 142, the driver 141 sends the display signal to the display 11*a*. Upon inputting the display signal, the display 11*a* flashes the entire screen of the cabinet display in white, and then, the display 11*a* sequentially flashes pixels in white in an order of rows and columns in the cabinet display 11-1 in step Sa9.

Figure 12:
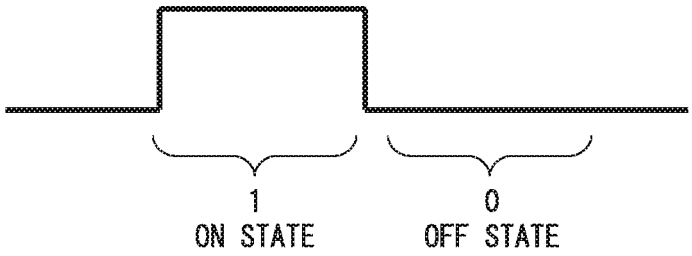
FIG. 12 shows a drive waveform to be periodically changed between an ON state and an OFF state.
Figure 13:
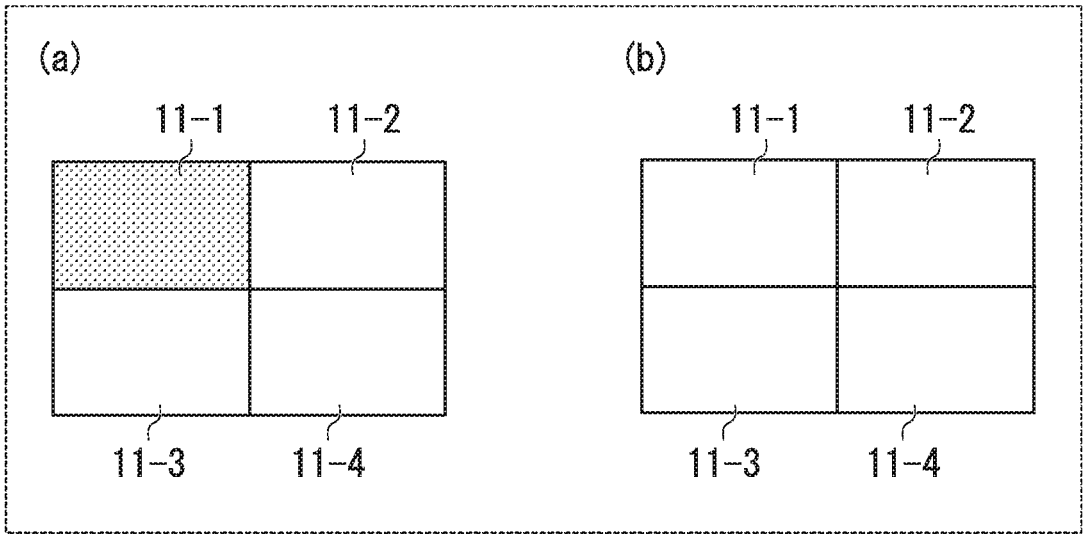
FIG. 13 shows examples of cabinet display operations applied to cabinet displays.

Upon inputting a display signal for depicting the entire screen of the cabinet display 11-1, for example, the display 11*a* depicts the entire screen of the cabinet display 11-1 in white as shown in FIG. 13(*a*) in an ON state, i.e. when a drive waveform superposed on the display signal is set to "1" as shown in FIG. 12. In FIG. 13, the colorless areas having the same color as the drawing sheet indicate an OFF state. FIG. 13(*a*) shows a white-display pattern (e.g. a dotted pattern) in the cabinet display 11-1 at an ON state of the drive waveform.

In an OFF state, i.e. when the drive waveform superposed on the display signal is set to "0" in FIG. 12, the display 11*a* turns off a display operation of the cabinet display 11-1 as shown in FIG. 13(*b*). Accordingly, it is possible to flash the entire screen of the cabinet display 11-1 according to predetermined patterns responsive to the ON/OFF states of the drive waveform.

Figure 14:
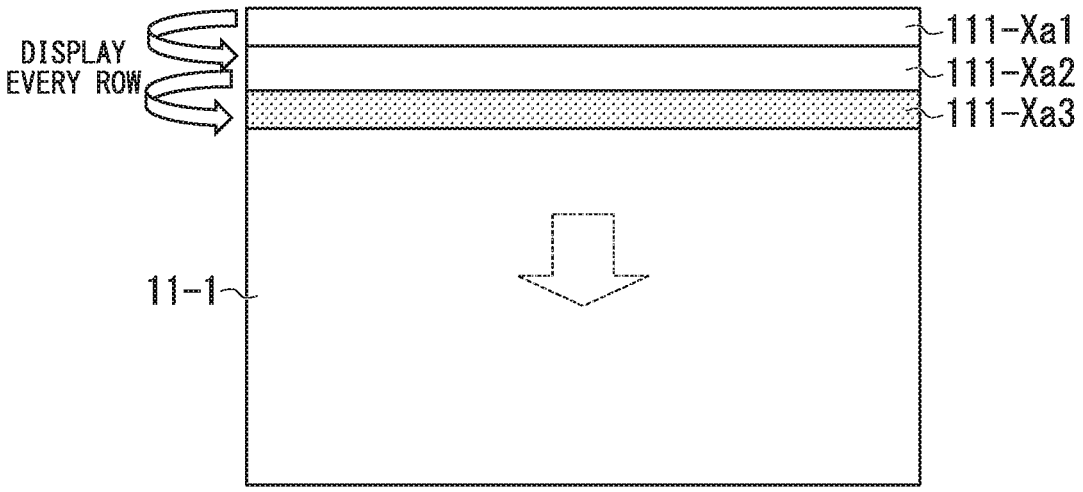
FIG. 14 shows an example of a cabinet display operation for sequentially depicting rows on a cabinet display.

Upon inputting a display signal for each row of the cabinet display 11-1, the display 11*a* sequentially depicts rows of pixels in white in an order of a first row 111-Xa1, a second row 111-Xa2, and a third row 111-Xa3 as shown in FIG. 14. In FIG. 14, the colorless areas having the same color of the drawing sheet indicate an OFF state. FIG. 14 shows that the third row 111-X3*a* is currently depicted in white.

To depict the first row 111-Xa1, the display 11*a* flashes the row 111-Xa1 according to the drive waveform, including the positional information of the first row, superposed on the drive signal. To depict the second row 111-Xa2, the display 11*a* flashes the row 111-Xa2 according to the drive waveform, including the positional information of the second row, superposed on the display signal. The above operation for flashing each row is repeated in a dotted-arrow direction towards the last row.

Figure 15:
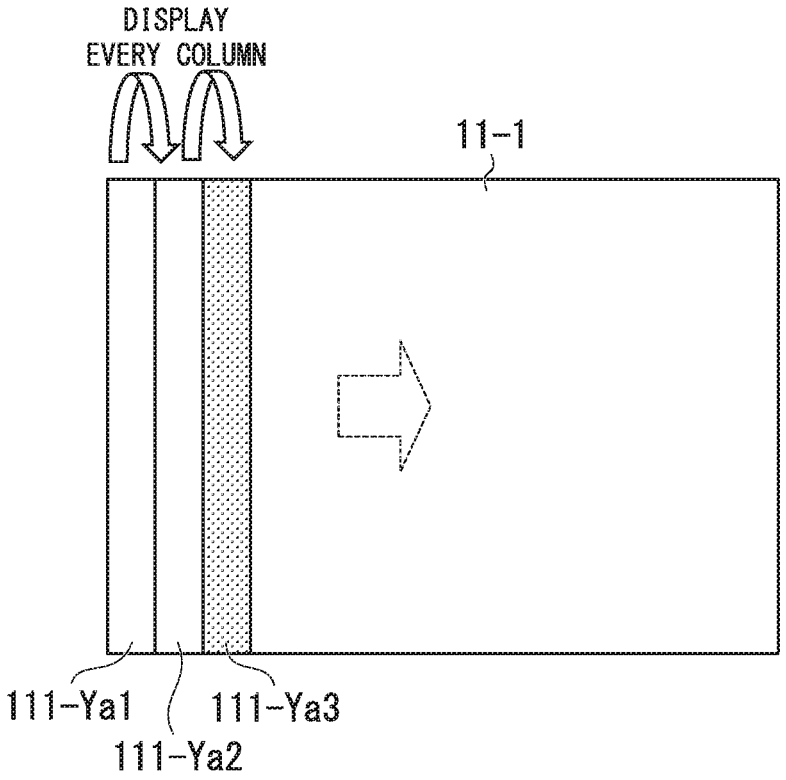
FIG. 15 shows an example of a cabinet display operation for sequentially depicting columns on a cabinet display.

Upon inputting a display signal for each column in the cabinet display 11-1, the display 11*a* sequentially depicts columns of pixels in white in an order of a first column 111-Ya1, a second column 111-Ya2, and a third column 111-Ya3 as shown in FIG. 15. In FIG. 15, the colorless areas having the same color of the drawing sheet indicate an OFF state. FIG. 15 shows that the third column 111-Ya3 is depicted in white.

To depict the first column 111-Ya1, the display 11*a* flashes the first column 111-Ya1 according to the drive waveform, including the positional information representing the first column, superposed on the drive signal. To depict the second column 111-Ya2, the display 11*a* flashes the column 111-Ya2 according to the drive waveform, including the positional information representing the second column, superposed on the display signal. The above operation for flashing each column is repeatedly carried out in a dotted-arrow direction towards the last column.

Upon completing the calibration display operation with respect to all the display signals, the display 11*a* sends the display completion information to the pixel selector 12*a*. Upon receiving the display completion information, the cabinet selector 121 of the pixel selector 12*a* determines whether or not all the cabinet displays 11-1 to 11-4 have been selected in step Sa10.

The display device 10*a* exits the aforementioned process when the cabinet selector 121 determines that all the cabinet displays 11-1 through 11-4 have been selected (i.e. "YES" in step Sa10). In contrast, the processing returns back to step Sa2 when the cabinet selector 121 determines that all the cabinet displays 11-1 through 11-4 have not been selected yet (i.e. "NO" in step Sa10). Subsequently, the cabinet selector 121 selects a single "unselected" cabinet display from among the cabinet displays 11-1 through 11-4 precluding the "selected" cabinet display 11-1. For example, the cabinet selector 121 selects the cabinet display 11-2 next to the cabinet display 11-1.

The cabinet selector 121 sends the cabinet number "2", assigned to the selected cabinet display 11-2, to the row selector 122, the column selector 123, the positional information generator 13*a*, and the light emission processor 14*a*, thus carrying out a series of steps starting with step Sa3.

Figure 16:
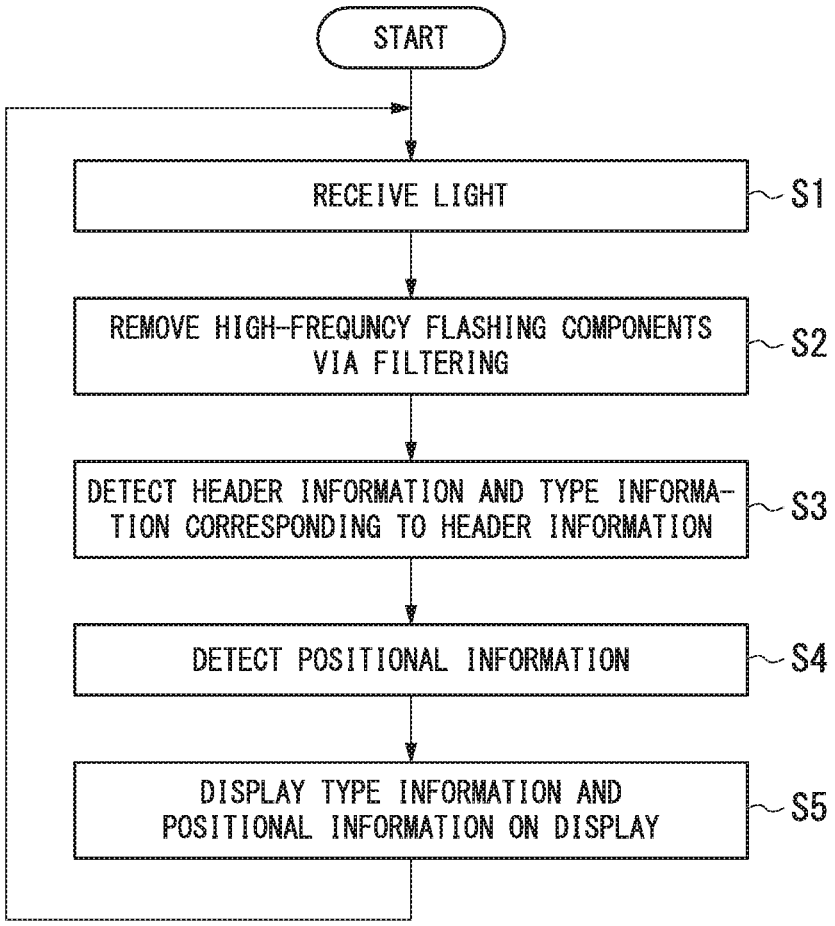
FIG. 16 is a flowchart showing a series of processes implemented by the position detecting device of the second embodiment.

FIG. 16 is a flowchart showing a series of processes implemented by the position detecting device 20*a* according to the second embodiment. In the following description, it is assumed that an operator will carry out a dot calibration for the pixel 111-40-50, which is located at the 40th row and the 50th column on the cabinet display 11-1 included in the display device 10*a* as shown in FIG. 3, thus adjusting a balance of luminance at the pixel 111-40-50.

Upon turning on a switch of the activation part 29, an operator moves the position detecting device 20*a* close to the cabinet display 11-1 such that the opening 202 of the position detecting device 20*a* will cover the pixel 111-40-50 located at the 40th row and the 50th column on the cabinet display 11-1. In addition, an operator presses a button of the display device 10*a* and thereby controls the calibration display start instruction part 15 to issue a calibration display start instruction, thus starting a calibration display operation on the display device 10*a*.

Upon starting a calibration display operation on the display device 10*a*, for example, it is assumed that the display device 10*a* would depict the entire screen of the cabinet display 11-1 in white. Subsequently, the photo-receiver 21*a* of the position detecting device 20*a* receive light emitted by the pixel 111-40-50 in step S1.

The photo-receiver 21*a* converts the received light into an electric signal, and then, the electric signal is sent to the positional information detector 22*a*. The filter 221 of the positional information detector 22*a* inputs the electric signal output from the photo-receiver 21*a*, and then, the filter 221 carries out low-pass filtering on the electric signal and thereby removes high-frequency flashing components from the electric signal. As a result of low-pass filtering, the filter 221 produces an electric signal having a low-frequency drive waveform. The filter 221 sends the electric signal having the low-frequency drive waveform to the decoder 222 in step S2.

The decoder 222 inputs the electric signal output from the filter 221, wherein the decoder 222 temporarily decodes the electric signal into a binary number and then converts the binary number into a hexadecimal number, thus restoring the information having the data format of FIG. 6. The decoder 222 detects the header information from the header section of the data format. With reference to the table stored on the storage 223, the decoder 222 detects the cabinet type as the type of the header information in step S3.

In addition, the decoder 222 detects the data information from the data section of the data format of FIG. 6, and then, the decoder 222 converts the data information into a decimal number as the positional information. As the positional number, it is possible to obtain the cabinet number "1" assigned to the cabinet display 11-1 in step S4. The decoder 222 sends the type information and the positional information to the output part 23*a*.

The output part 23*a* displays the type information and the positional information on screen. For example, the output part 23*a* displays a text message "Cabinet: 1" on screen in step S5.

Until an operator turns off the switch of the activation part 29, the position detecting device 20*a* repeatedly carries out a series of steps S1 through S5. Subsequently, the display device 10*a* carries out a row calibration to sequentially depict rows of pixels from a first row to a last row on screen. When the display device 10*a* depicts a 40th line on screen, the photo-receiver 21*a* of the position detecting device 20*a* receives light emitted by the pixel 111-40-50. In this connection, the received light is superposed with the positional information representing the position of the 40th row on screen. After executing a series of steps S2 through S4, for example, the output part 23*a* of the position detecting device 20*a* displays a text message "Row: 40" on screen in step S5.

Subsequently, the display device 10*a* carries out a column calibration to sequentially depict columns of pixels from a first column to a last column on screen. When the display device 10*a* depicts a 50th column on screen, the photo-receiver 21*a* receives light emitted by the pixel 111-40-50. The received light is superposed with the positional information representing the position of the 50th column on screen. After executing a series of steps S1 through S4, for example, the output part 23*a* of the position detecting device 20*a* displays a text message "Column: 50" on screen.

The aforementioned operation makes it possible for an operator to accurately and easily detect that the position of the pixel 111-40-50 subjected to calibration is located at the 40th row and the 50th column of the cabinet display 11-1. Accordingly, it is possible to reduce the time required for an operator to detect the position of the pixel 111-40-50 subjected to calibration. Using the positional information, it is possible for an operator to carry out a dot calibration on the display device 10*a* such that an operator can adjust a balance of luminance by viewing the luminance of the pixel 111-40-50 with his/her eyes.

According to the second embodiment described above, the display 11*a* of the display device 10*a* includes a plurality of sections, namely cabinets, each of which further includes a plurality of pixels having a plurality of LEDs aligned in a matrix. The pixel selector 12*a* selects the pixels 111 to emit light for every cabinet, every row or every column on screen. The positional information generator 13*a* generates the positional information regarding each cabinet, each row or each column for aligning the pixels 111 selected by the pixel selector 12*a*. To emit light by the pixels 111 selected by the pixel selector 12*a*, the light emission processor 14*a* superposes the positional information, which is generated by the positional information generator 13*a*, on the light emitted by the pixels 111 selected by the pixel selector 12*a*.

The photo-receiver 21*a* of the position detecting device 20*a* receives light emitted by the pixels 111 having LEDs on the display device 10*a*. The positional information detector 22*a* detects the positional information superposed on the light received by the photo-receiver 21*a*. The output part 23*a* outputs the positional information detected by the positional information detector 22*a*. Accordingly, it is possible to easily detect the position of the pixel 111 subjected to calibration, which is determined via operator's viewing, using the position detecting device 20*a* applied to the display device 10*a* including a plurality of pixels.

In the second embodiment, the cabinet selector 121, the row selector 122, and the column selector 123 are synchronized together to carry out a loop La1*s*-La1*e* following step Sa4 and a loop La2*s*-La2*e* following the loop La1*s*-La1*e* as shown in FIG. 11; however, the present invention is not necessarily limited to the second embodiment. For example, it is possible to employ another configuration in which the display signal generator 142 is equipped with a buffer configured to store packets in connection with the positional information representing cabinet numbers, row numbers, and column numbers. According to this configuration, it is possible to store the positional information and the packets correlated to the positional information on a buffer without intermingling them. This makes it possible to carry out a process of steps Sa2-Sa4, a process of the loop La1*s*-La1*e*, and a process of the loop La2*s*-La2*e* in parallel. Generating display signals in parallel may cause a possibility that an order of generating display signals may not be formulated in an order of a full-screen display, a display of each row, and a display of each column. For example, this may cause an inappropriate order of displays on the display 11*a* such that, after depicting one row on screen, one column is depicted on the screen corresponding to any one of the cabinet displays 11-1 through 11-4.

3. Third Embodiment

Figure 17:
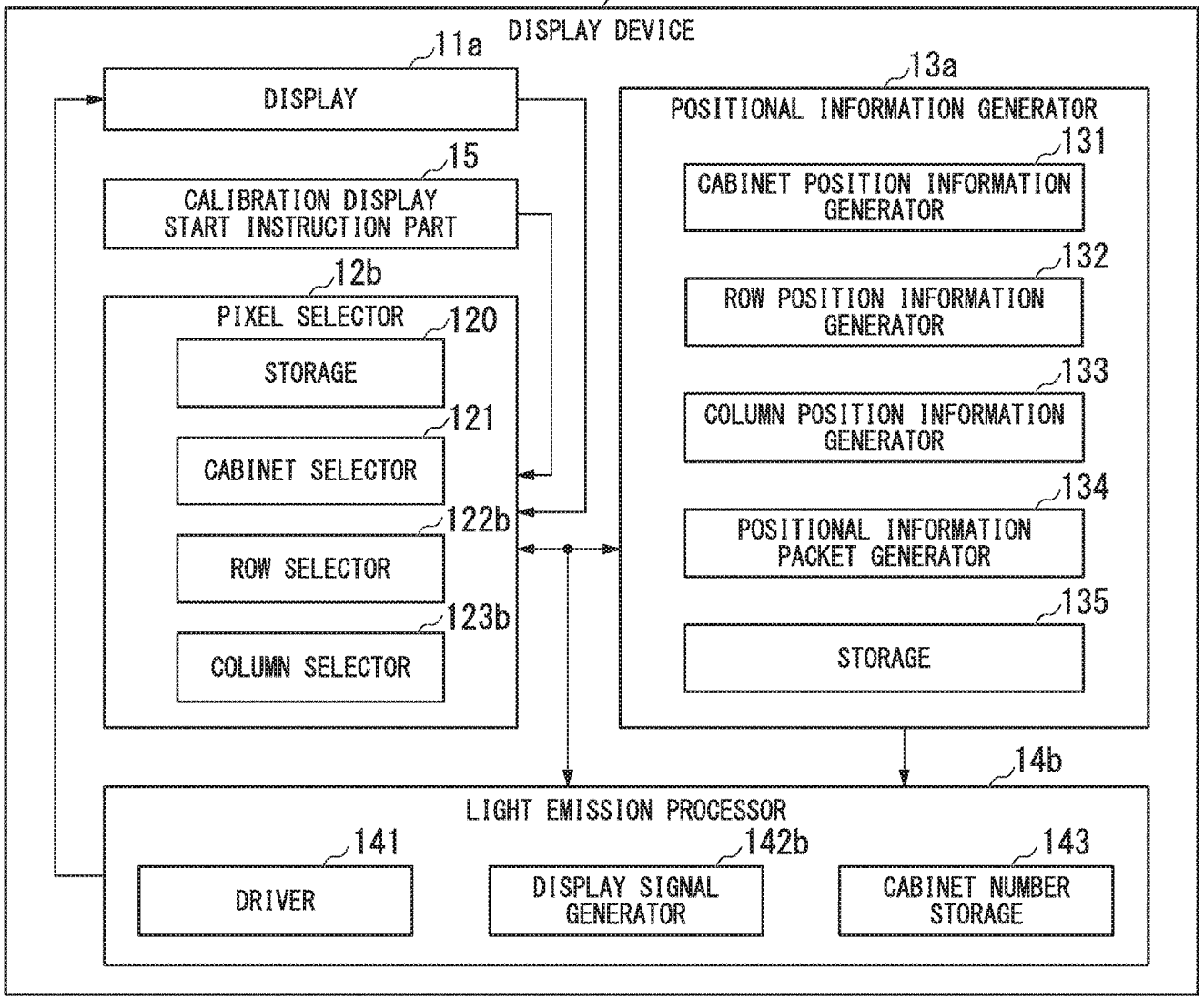
FIG. 17 is a block diagram of a display device according to the third embodiment of the present invention.

FIG. 17 is a block diagram of a display device 10*b* according to the third embodiment of the present invention.

According to the second embodiment, the display device 10*a* carries out a calibration display operation for each row and for each column. In contrast, the display device 10*b* of the third embodiment carries out a calibration display operation for each unit of three rows and for each unit of three columns by repeatedly selecting three consecutive rows without overlapping other rows and by repeatedly selecting three consecutive columns without overlapping other columns.

In the display device 10*b* shown in FIG. 17, the parts identical to those of the display device 10*a* shown in FIG. 4 are denoted using the same reference signs; hence, the following descriptions will solely refer to differences between the display devices 10*a* and 10*b*. The display device 10*b* includes the display 11*a*, a pixel selector 12*b*, the positional information generator 13*a*, a light emission processor 14*b*, and the calibration display start instruction part 15.

The pixel selector 12*b* includes the storage 120, the cabinet selector 121, a row selector 122*b*, and a column selector 123*b*. With reference to the storage 120, the row selector 122*b* of the pixel selector 12*b* sequentially selects three consecutive rows subjected to a calibration display operation without overlapping other rows from a first row to a last row within a range of rows correlated to the cabinet number output from the cabinet selector 121. In addition, the row selector 122*b* sends the row numbers of the selected three rows to the light emission processor 14*b* while sending the row number corresponding to the center of the selected three rows to the positional information generator 13*a*.

With reference to the storage 120, the column selector 123*b* sequentially selects three consecutive columns subjected to a calibration display operation without overlapping other columns from a first column to a last column within a range of columns correlated to the cabinet number output from the cabinet selector 121. In addition, the column selector 123*b* sends the column numbers of the selected three columns to the light emission processor 14*b* while sending the column number corresponding to the center of the selected three columns to the positional information generator 13*a*.

The light emission processor 14*b* differs from the light emission processor 14*a* by including the display signal generator 142*b* instead of the display signal generator 142. Similar to the display signal generator 142, the display signal generator 142*b* inputs the cabinet number output from the cabinet selector 121 and thereby writes and stores the cabinet number on the cabinet number storage 143. In addition, the display signal generator 142 generates a display signal for depicting in white the entire screen of the cabinet display 11 corresponding to the cabinet number among the cabinet displays 11-1 through 11-4. The display signal generator 142*b* superposes a drive waveform, including the positional information generated by the positional information packet generator 134 based on the cabinet number, on the display signal for depicting the entire screen of the cabinet display 11, thus outputting the display signal superposed with the drive waveform to the driver 141.

Upon inputting three row numbers output from the row selector 122*b*, the display signal generator 142*b* generates a display signal for depicting in white three rows corresponding to three row numbers on the cabinet display 11 corresponding to the cabinet number stored on the cabinet number storage 143 among the cabinet displays 11-1 through 11-4. In addition, the display signal generator 142 superposes a drive waveform including the positional information, which is generated by the positional information packet generator 134 based on the row number corresponding to the center of three rows, on the display signal for depicting three rows, thus outputting the display signal superposed with the drive waveform to the driver 141.

Upon inputting three column numbers output from the column selector 123*b*, the display signal generator 142*b* generates a display signal for depicting in white three columns corresponding to three column numbers on the cabinet display 11 corresponding to the cabinet number stored on the cabinet number storage 143 among the cabinet displays 11-1 through 11-4. In addition, the display signal generator 142 superposes a drive waveform including the positional information, which is generated by the positional information packet generator 134 based on the column number corresponding to the center of three columns, on the display signal for depicting three columns, thus outputting the display signal superposed with the drive waveform to the driver 141.

Figure 18:
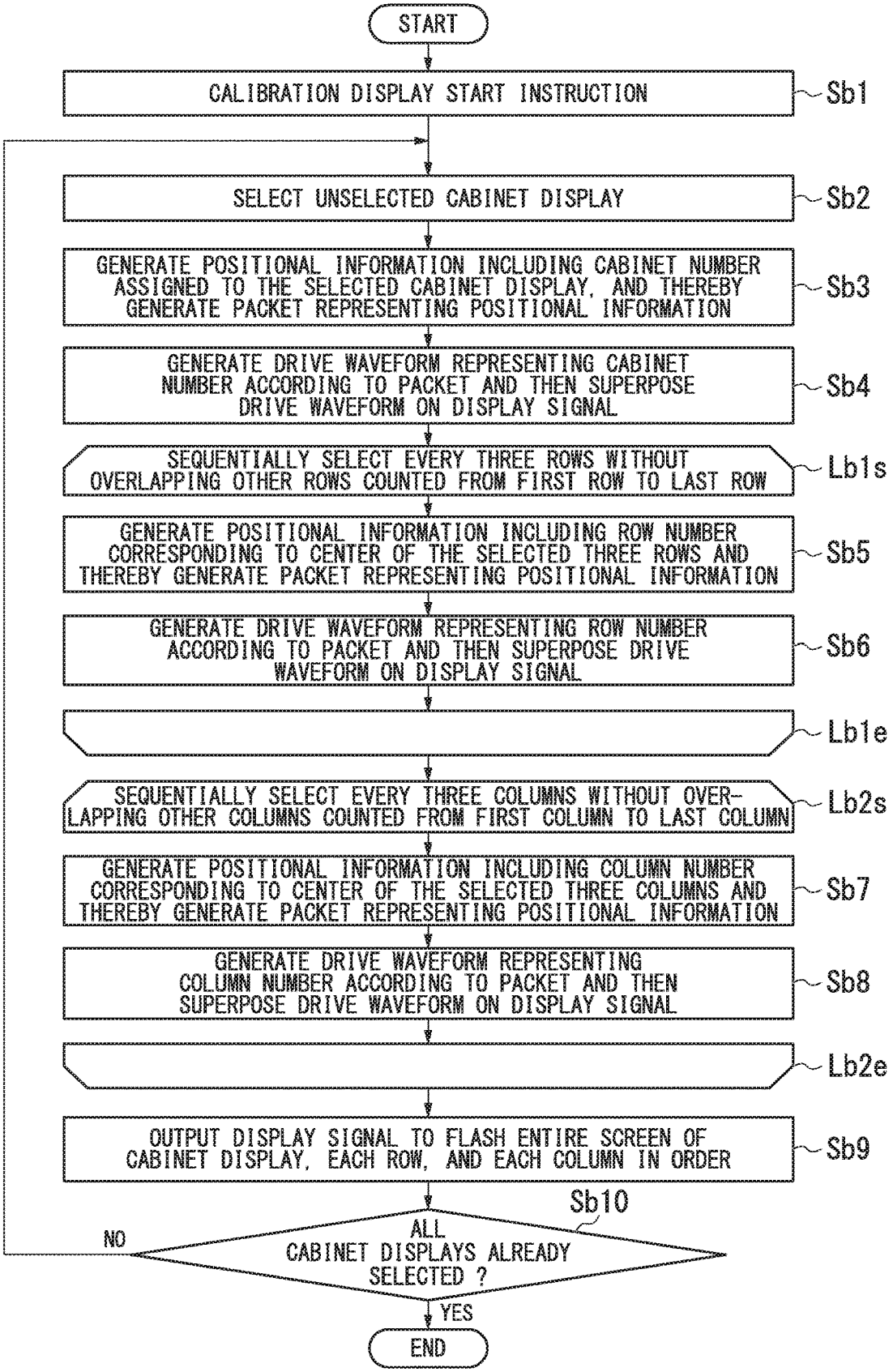
FIG. 18 is a flowchart showing a series of processes implemented by the display device of the third embodiment.

FIG. 18 is a flowchart showing a series of processes implemented by the display device 10*b* of the third embodiment. In FIG. 18, the steps Sb1 through Sb4 and the step Sb10 are identical to the steps Sa1 through Sa4 and the step Salt) which are executed by the display device 10*a* of the second embodiment as shown in FIG. 11. The following descriptions refer to a series of steps following the step Sb4.

With reference to the storage 120, the row selector 122*b* selects three consecutive rows counted from a first row without overlapping other rows within a range of rows correlated to the cabinet number output from the cabinet selector 121. Specifically, the row selector 122*b* selects every three rows such that it selects first to third rows at first and then selects fourth to sixth rows on screen.

The row selector 122*b* sends the row number of the selected three rows to the light emission processor 14*b* while the row selector 122*b* sends the row number corresponding to the center of the selected three rows to the positional information generator 13*a*. Upon inputting the row number corresponding to the center of three rows output from the row selector 122*b*, the row position information generator 132 of the positional information generator 13*a* converts the row number from a decimal number to a hexadecimal number.

The row position information generator 132 reads a header "0xF1" representing the row type from the table of the storage 135, and then, the row position information generator 132 sends the header and the row number, which is converted into a hexadecimal number, to the positional information packet generator 134.

The positional information packet generator 134 generates a packet having the data format of FIG. 6 based on the header information and the data information output from the row position information generator 132. The positional information packet generator 134 sends the packet to the light emission processor 14*b* in step Sb5.

Upon inputting the row numbers of three rows output from the row selector 122*b*, the display signal generator 142*b* of the light emission processor 14*b* reads the cabinet number stored on the cabinet number storage 143. The display signal generator 142*b* generates a display signal for depicting in white three rows corresponding to the three row numbers in the cabinet display 11 corresponding to the cabinet number among the cabinet displays 11-1 through 11-4.

Upon inputting the packet output from the positional information packet generator 134, the display signal generator 142*b* generates a drive waveform including the positional information of the row number based on the packet.

The display signal generator 142*b* superposes the drive waveform on the display signal and thereby sends the display signal superposed with the drive waveform to the driver 141 in step Sb6.

The row selector 122*b*, the row position information generator 132, the positional information packet generator 134, and the display signal generator 142*b* cooperate together to repeatedly carry out a series of steps Sb5-Sb6 in a loop Lb1*s*-Lb1*e* in an order of the first row to the last row.

With reference to the storage 120, the column selector 123*b* selects consecutive three columns counted from the first column without overlapping other columns within a range of columns correlated to the cabinet number output from the cabinet selector 121. Specifically, the column selector 123*b* selects every three columns such that it selects first to third columns at first and then selects fourth to six columns on screen.

The column selector 123*b* sends the column numbers of the selected three columns to the light emission processor 14*b* while the column selector 123*b* sends the column number corresponding to the center of the selected three columns to the positional information generator 13*a*. Upon inputting the column number corresponding to the center of three columns output from the column selector 123*b*, the column position information generator 133 of the positional information generator 13*a* converts the column number from a decimal number to a hexadecimal number.

The column position information generator 133 reads a header "0xF2" representing the column type from the table of the storage 135, and then, the column position information generator 133 sends the header and the column number, which is converted into a hexadecimal number, to the positional information packet generator 134.

The positional information packet generator 134 generates a packet having the data format of FIG. 6 based on the header information and the data information output from the column position information generator 133. The positional information packet generator 134 sends the packet to the light emission processor 14*b* in step Sb7.

Upon inputting three column numbers output from the column selector 123*b*, the display signal generator 142*b* of the light emission processor 14*b* reads the cabinet number stored on the cabinet number storage 143. The display signal generator 142*b* generates a display signal for depicting in white three columns corresponding to three column numbers in the cabinet display 11 corresponding to the cabinet number among the cabinet displays 11-1 through 11-4.

Upon inputting the packet output from the positional information packet generator 134, the display signal generator 142*b* generates a drive waveform including the positional information of the column number based on the packet. The display signal generator 142*b* superposes the drive waveform on the display signal and thereby sends the display signal superposed with the drive waveform to the driver 141 in step Sb8.

The column selector 123*b*, the column position information generator 133, the positional information packet generator 134, and the display signal generator 142*b* cooperate together to repeatedly carry out a series of steps Sb7-Sb8 in a loop Lb2*s*-Lb2*e* in an order of the first column to the last column.

Upon inputting the display signal superposed with the drive waveform output from the display signal generator 142*b*, the driver 141 sends the display signal to the display 11*a*. Upon inputting the display signal, the display 11*a* flashes the entire screen of the cabinet display 11 in white, which is selected by the cabinet selector 121 in step Sb2 among the cabinet displays 11-1 through 11-4, and then, the display 11*a* sequentially flashes every three rows in white in step Sb9.

Figure 19:
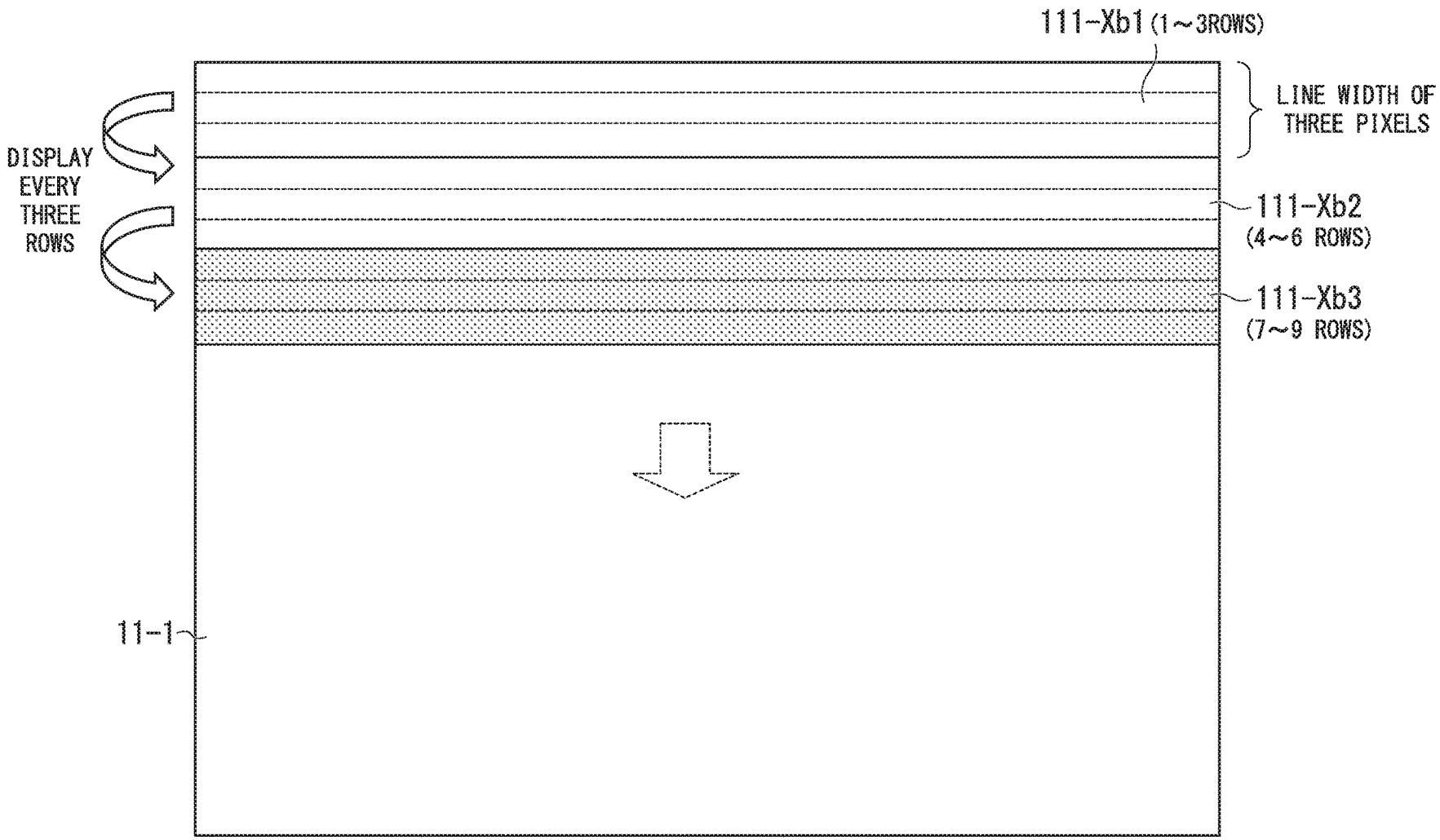
FIG. 19 shows an example of a cabinet display operation for sequentially depicting every three rows on a cabinet display.

As shown in FIG. 19, for example, the display 11*a* sequentially depicts every three rows without overlapping other rows on the cabinet display 11-1 such that it depicts a row segment 111-Xb1 including first to third rows at first and then depicts a row segment 111-Xb2 including fourth to sixth rows. In FIG. 19, the colorless areas having the same color of the drawing sheet indicate an OFF state. FIG. 19 shows that the display 11*a* currently depicts a row segment 111-Xb3 including seventh to ninth rows on screen.

A display calibration system according to the third embodiment includes the display device 10*b* of the third embodiment and the position detecting device 20*a* of the second embodiment. For this reason, an operator who conducts calibrations detects the positions of pixels subjected to calibration using the position detecting device 20*a* of the second embodiment. To detect the position of the pixel 111 in the third embodiment similar to the second embodiment, an operator moves the position detecting device 20*a* close to the display 11*a* such that the pixel 111 will be covered by the opening 202 of the position detecting device 20*a*, thus detecting the position of the pixel 111. Similar to the second embodiment for detecting the position of the pixel 111-40-50, for example, the detecting timing about rows is set to the timing of concurrently depicting three rows such as 40th, 41st, and 42nd rows while the detecting timing about columns is set to the timing of concurrently depicting three columns such as 49th, 50th, and 51st columns.

The positional information to be superposed on a display signal at the timing of concurrently depicting three rows such as 40th, 41st, and 42nd rows would be the positional information corresponding to the center of three rows, i.e. the 41st row. In addition, the positional information to be superposed on a display signal at the timing of concurrently depicting three columns such as 49th, 50th, and 51st columns would be the positional information corresponding to the center of three columns, i.e. the 50th column.

When an operator moves the position detecting device 20*a* close to the display 11*a* such that the pixel 111-40-50 will be covered by the opening 202 of the position detecting device 20*a*, the output part 23*a* of the position detecting device 20*a* sequentially displays text messages on screen in an order of a text message "Cabinet: 1", a text message "Row: 41", and a text message "Column: 50". Accordingly, an operator who conducts calibrations on the display device 10*b* of the third embodiment is able to recognize that the pixel 111-40-50 may be located close to the 41st row and the 50th column on the cabinet display 11-1 having the cabinet number "1".

To calibrate the luminance of the pixel 111-40-50, it is necessary to detect a further accurate position of the pixel 111-40-50. In a calibration display operation for the display device 10*a* of the second embodiment, for example, it is possible to partially modify the flowchart of FIG. 11 such that a loop La1*s*-La1*e* will be repeatedly applied to a range of rows around the 41st row, i.e. a range of 40th to 42nd rows, instead of a range of first to last rows. In addition, it is possible to partially modify the flowchart of FIG. 11 such that a loop La2*s*-La2*e* will be repeatedly applied to a range of columns around the 50th column, i.e. a range of 49th to 51st columns, instead of a range of first to last columns. Accordingly, it is possible for an operator to detect an accurate position of the pixel 111-40-50.

According to the third embodiment, the display device 10*b* depicts every three rows without overlapping other rows while depicting every three columns without overlapping other columns. This may reduce an accuracy of detecting positional information in the display device 10*b* of the third embodiment compared to the display device 10*a* of the second embodiment. However, the third embodiment is advantageous because it is possible to carry out calibration display operations for rows and columns in all the cabinet displays 11-1 through 11-4 in a short period of time. In this connection, the configuration of the third embodiment (i.e. the display device 10*b*) is used to roughly locate an area around the pixel 111 subjected to calibration. Thereafter, the configuration of the second embodiment (i.e. the display device 10*a*) is used to detect an accurate position of the pixel 111 subjected to calibration within the limited area. Considering a very large size of the cabinet displays 11-1 through 11-4, it is advantageous to combine the configuration of the second embodiment and the configuration of the third embodiment rather than solely using the configuration of the second embodiment because it is possible to detect an accurate position of the pixel in a short period of time.

The display device 10*b* of the third embodiment is designed to concurrently depict three consecutive rows and three consecutive columns on screen; but the present invention is not necessarily limited to the third embodiment. The number of rows and the number of columns are not necessarily limited to "3"; hence, it is possible to adopt an arbitrary number of rows and an arbitrary number of columns. For example, it is possible to determine an appropriate number of rows and appropriate number of columns depending on the number of pixels included in the cabinet displays 11-1 through 11-4.

According to the third embodiment, the row selector 122*b* selects consecutive three rows without overlapping other rows. For this reason, the row selector 122*b* may not select three rows at last when the number of rows included in the cabinet displays 11-1 through 11-4 is not a multiple of three. In this case, the row selector 122*b* may select the last one row or the last two rows. For example, the row position information generator 132 may generate the positional information representing the last one row selected by the row selector 122*b*, alternatively, the row position information generator 132 may generate the positional information representing the second one of the two rows selected by the row selector 122*b*.

Similarly, when the number of columns is not a multiple of three, the column selector 123*b* may select the last column or the last two columns. For example, the column position information generator 133 may generate the positional information representing the last column selected by the column selector 123*b*, alternatively, the column position information generator 133 may generate the positional information representing the second one of the last two columns selected by the column selector 123*b*.

4. Fourth Embodiment

Figure 20:
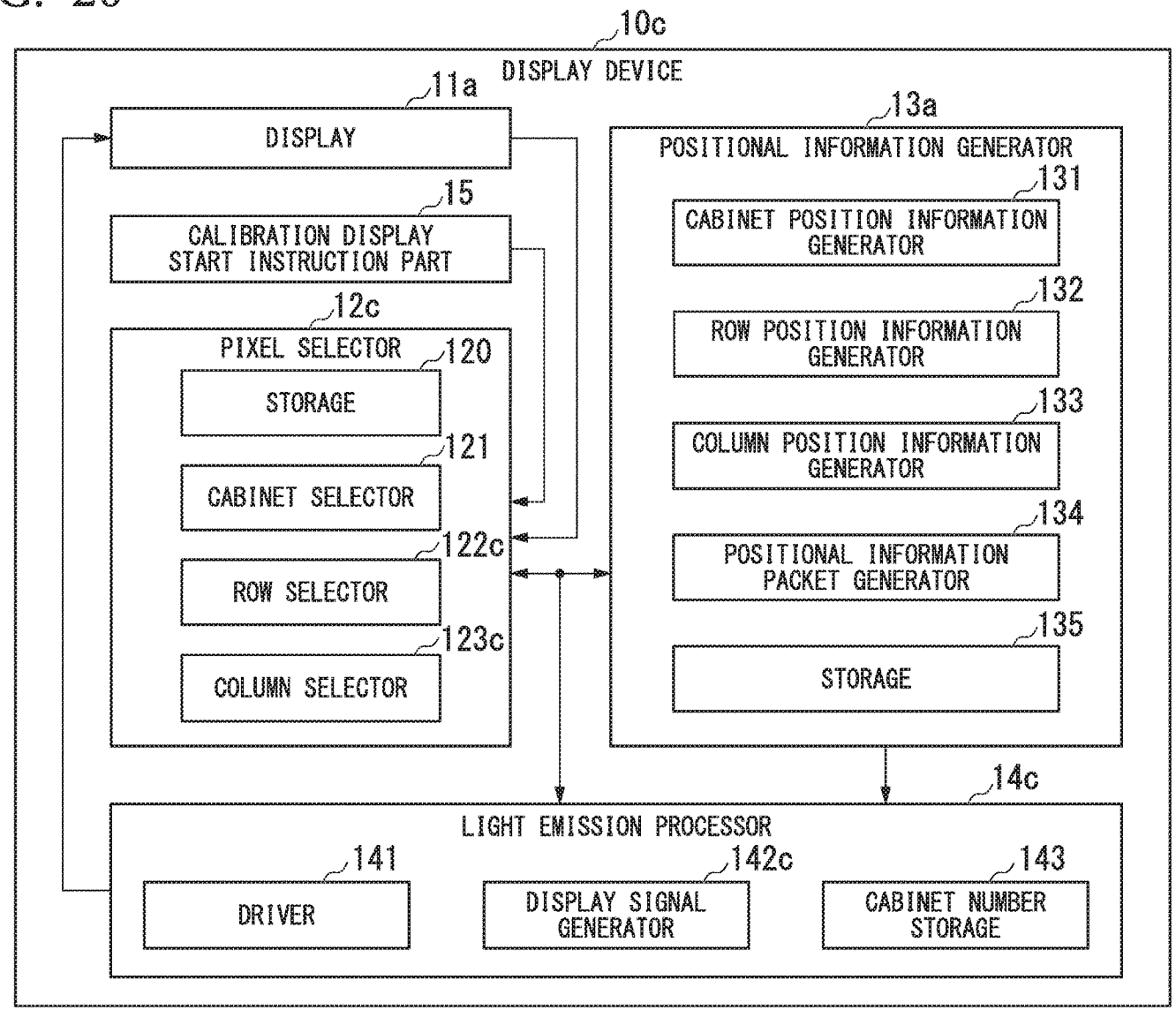
FIG. 20 is a block diagram of a display device according to the fourth embodiment of the present invention.

FIG. 20 is a block diagram of a display device 10*c* according to the fourth embodiment of the present invention. The display device 10*a* of the second embodiment carries out calibration display operations for each row and for each column. In contrast, the display device 10*c* of the fourth embodiment carries out calibration display operations for rows and for columns such that multiple rows/columns are concurrently depicted on screen with a certain interval of rows/columns.

In the display device 10*c* shown in FIG. 20, the parts identical to those of the display device 10*a* shown in FIG. 4 are denoted using the same reference signs; hence, the following descriptions refer to differences between the display devices 10*a* and 10*c*. The display device 10*c* includes the display 11*a*, a pixel selector 12*c*, the positional information generator 13*a*, a light emission processor 14*c*, and the calibration display start instruction part 15.

The pixel selector 12*c* includes the storage 120, the cabinet selector 121, a row selector 122*c*, and a column selector 123*c*. With reference to the storage 120, the row selector 122*c* selects multiple rows subjected to calibration display operations within a range of rows correlated to the cabinet number output from the cabinet selector 121 with a certain interval of rows, e.g. twenty rows. In addition, the row selector 122*c* sends the row numbers of the selected rows to the light emission processor 14*b*.

The row selector 122*c* sends to the positional information generator 13*a* the minimum row number among the row numbers of the selected rows. To select multiple rows with an interval of twenty rows, for example, the row selector 122*c* firstly selects a combination of row numbers such as "1", "21", "41", etc. In this combination, the relative position of each row number, i.e. the relative position in an interval of multiple rows, should be set to the first row, i.e. "1". Subsequently, the row selector 122*c* selects a next combination of row numbers such as "2", "22", "42", etc. In this combination, the relative position of each row number should be set to the second row, i.e. "2". For this reason, the row selector 122*c* selects the minimum row number among the row numbers of the selected rows, and therefore, the minimum row number represents the relative row number within an interval of the selected rows.

With reference to the storage 120, the column selector 123*c* selects multiple columns subjected to calibration display operations within a range of columns correlated to the cabinet number output from the cabinet selector 121 with a certain interval of columns, e.g. twenty columns. In addition, the column selector 123*c* sends the column numbers of the selected columns to the light emission processor 14*b*. The column selector 123*c* sends to the positional information generator 13*a* the minimum column number among the column numbers of the selected columns.

Similar to the display signal generator 142, the display signal generator 142*c* inputs the cabinet number output from the cabinet number selector 121 and thereby writes and stores the cabinet number on the cabinet number storage 143. Similar to the display signal generator 142, the display signal generator 142*c* generates a display signal for depicting the entire screen of the cabinet display in white corresponding to the cabinet number among the cabinet displays 11-1 through 11-4. In addition, the display signal generator 142*c* superposes a drive waveform, including the positional information generated by the positional information packet generator 134 based on the cabinet number, on the display signal for depicting the entire screen of the cabinet display 11 and thereby sends the display signal superposed with the drive waveform to the driver 141.

Upon inputting multiple row numbers output from the row selector 122*c*, the display signal generator 142*c* generates a display signal for depicting in white multiple rows corresponding to multiple row numbers on the cabinet display 11 corresponding to the cabinet number stored on the cabinet number storage 143 among the cabinet displays 11-1 through 11-4. In addition, the display signal generator 142*c* superposes a drive waveform including the positional information, which is generated by the positional information packet generator 134 based on the relative row number among multiple row numbers, on the display signal for depicting multiple rows and thereby sends the display signal superposed with the drive waveform to the driver 141.

Upon inputting multiple column numbers output from the column selector 123*c*, the display signal generator 142*c* generates a display signal for depicting in white multiple columns corresponding to multiple column numbers on the cabinet display 11 corresponding to the cabinet number stored on the cabinet number storage 143 among the cabinet displays 11-1 through 11-4. In addition, the display signal generator 142*c* superposes a drive waveform including the positional information, which is generated by the positional information packet generator 134 based on the relative column number among multiple column numbers, on the display signal for depicting multiple columns and therefore sends the display signal superposed with the drive waveform to the driver 141.

Figure 21:
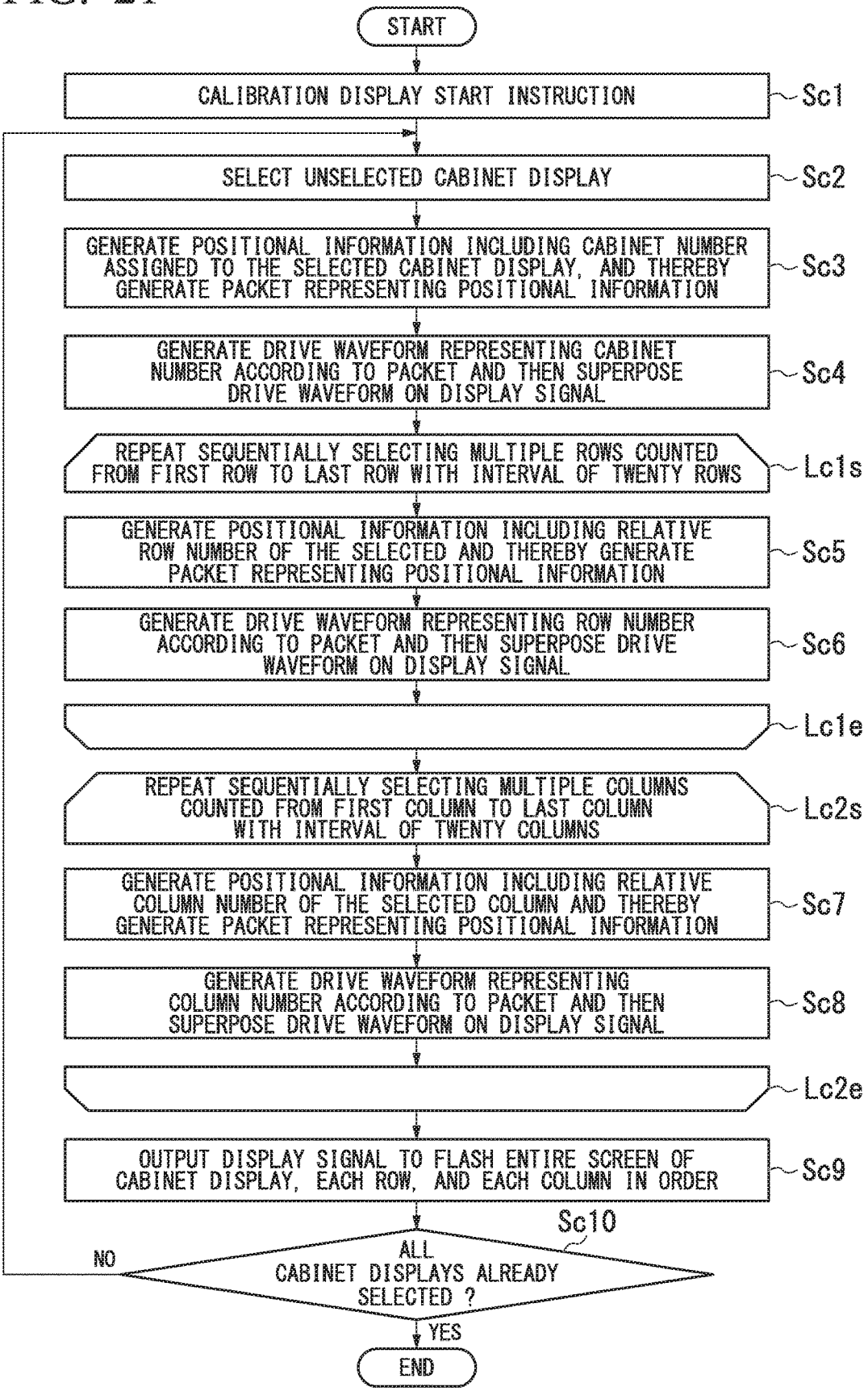
FIG. 21 is a flowchart showing a series of processes implemented by the display device of the fourth embodiment.

FIG. 21 is a flowchart showing a series of processes implemented by the display device 10*c* of the fourth embodiment. In FIG. 21, a series of steps Sc1-Sc4 and step Sc10 are identical to a series of steps Sa1-Sa4 and Sa10 implemented by the display device 10*a* of the second embodiment. It is assumed that an interval of rows and an interval of columns are set to twenty rows and twenty columns respectively in the following descriptions regarding a series of processes following step Sc4.

With reference to the storage 120, the row selector 122*c* repeatedly and sequentially select multiple rows counted from the first row to the last row within a range of rows correlated to the cabinet number output from the cabinet selector 121 with an interval of twenty rows. As described above, for example, the row selector 122*c* selects a first combination of row numbers such as "1", "21", "41", etc. and then selects a next combination of row numbers such as "2", "22", "42", etc.

The row selector 122*c* sends multiple row numbers of the selected rows to the light emission processor 14*c*. In addition, the row selector 122*c* sends the minimum row number among the selected row numbers to the positional information generator 13*a*.

Upon inputting the row number output from the row selector 122*c*, the row position information generator 132 of the positional information generator 13*a* converts the row number from a decimal number to a hexadecimal number. The row position information generator 132 reads a header "0xF1" corresponding to the row type from the table of the storage 135, and then, the row position information generator 132 sends the header and the row number, which is converted into a hexadecimal number, to the positional information packet generator 134.

The positional information packet generator 134 generates a packet having the data format of FIG. 6 based on the header information and the data information output from the row position information generator 132. The positional information packet generator 134 sends the packet to the light emission processor 14*c* in step Sc5.

Upon inputting the row numbers of multiple rows output from the row selector 122*c*, the display signal generator 142*c* of the light emission processor 14*c* reads the cabinet number stored on the cabinet number storage 143. The display signal generator 142*c* generates a display signal for depicting multiple rows corresponding to the row numbers on the cabinet display 11 corresponding to the cabinet number among the cabinet displays 11-1 through 11-4.

Upon inputting a packet output from the positional information packet generator 134, the display signal generator 142*c* generates a drive waveform including the positional information of the row number based on the packet. The display signal generator 142*c* superposes the drive waveform on the display signal and thereby sends the display signal superposed with the drive waveform to the driver 141 in step Sc6.

The row selector 122*c*, the row position information generator 132, the positional information packet generator 134, and the display signal generator 142*c* cooperate together to repeatedly carry out a series of steps Sc5-Sc6 twenty times, i.e. the number of times corresponding to the number of rows included in an interval of twenty rows in a loop Lc1*s*-Lc1*e*.

With reference to the storage 120, the column selector 123*c* repeatedly selects multiple columns counted from the first column within a range of columns correlated to the cabinet number output from the cabinet selector 121 with an interval of twenty columns. As described above, for example, the column selector 123*c* firstly selects a combination of columns, i.e. column numbers "1", "21", "41", etc., and then the column selector 123*c* selects a next combination of columns, i.e. column numbers "2", "22", "42", etc.

The column selector 123*c* sends the column number of the selected columns to the light emission processor 14*c*. In addition, the column selector 123*c* sends the minimum column number among the column numbers of the selected columns to the positional information generator 13*a*.

Upon inputting the column number output from the column selector 123*c*, the column position information generator 133 of the positional information generator 13*a* converts the column number from a decimal number to a hexadecimal number. The column position information generator 133 reads a header "0xF2" representing the column type from the table of the storage 135, and then, the column position information generator 133 sends the header and the column number, which is converted into a hexadecimal number, to the positional information packet generator 134.

The positional information packet generator 134 generates a packet having the data format of FIG. 6 based on the header information and the data information output from the column position information generator 133. The positional information packet generator 134 sends the packet to the light emission processor 14*c* in step Sc7.

Upon inputting multiple column numbers output from the column selector 123*b*, the display signal generator 142*c* of the light emission processor 14*c* reads the cabinet number stored on the cabinet number storage 143. The display signal generator 142*c* generates a display signal for depicting in white multiple columns corresponding to multiple column numbers on the cabinet display corresponding to the cabinet number among the cabinet displays 11-1 through 11-4.

Upon inputting a packet output from the positional information packet generator 134, the display signal generator 142*c* generates a drive waveform including the positional information of the column number based on the packet. The display signal generator 142*c* superposes the drive waveform on the display signal and thereby sends the display signal superposed with the drive waveform to the driver 141 in step Sc8.

The column selector 123*c*, the column position information generator 133, the positional information packet generator 134, and the display signal generator 142*c* cooperate together to repeatedly carry out a series of steps Sc7-Sc8 twenty times, i.e. the number of times corresponding to the number of columns included in an interval of twenty columns in a loop Lc2*s*-Lc2*e*.

Upon inputting the display signal superposed with the drive waveform output from the display signal generator 142*c*, the driver 141 sends the display signal to the display 11*a*. Upon inputting the display signal, the display 11*a* flashes the entire screen of each cabinet display in white, which is selected by the cabinet selector 121 among the cabinet displays 11-1 through 11-4 in step Sc2, and then, the display 11*a* flashes multiple rows and multiple columns in white in step Sc9.

Figure 22:
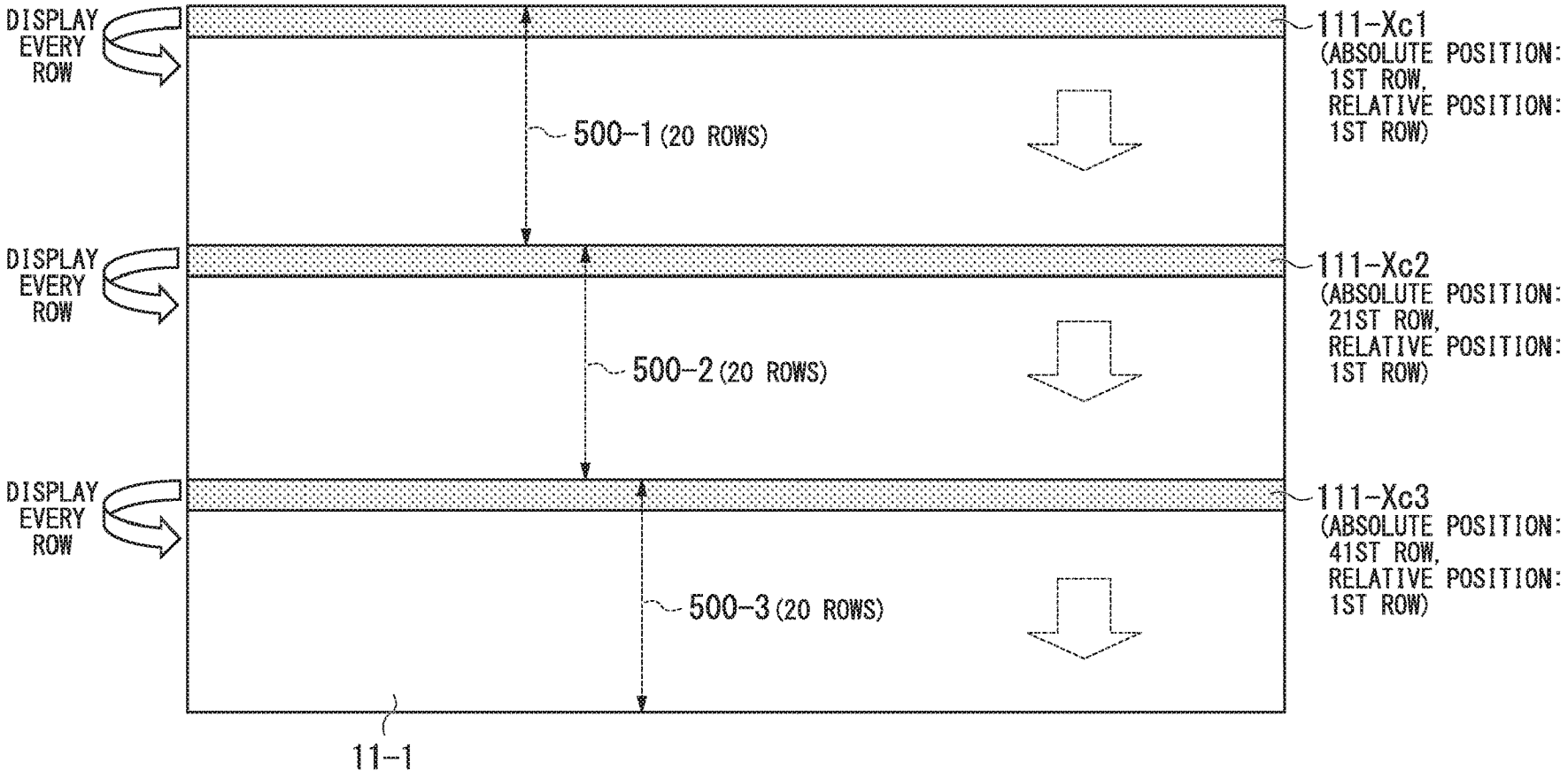
FIG. 22 shows a calibration display operation for displaying multiple rows with an interval of rows.

As shown in FIG. 22, for example, the display 11*a* concurrently depicts three rows, i.e. a row 111-Xc1 having an absolute position of a first row, a row 111-Xc2 having an absolute position of a 21st row, and a row 111-Xc3 having an absolute position of a 41st row, on the cabinet display 11-1. In this connection, all the three rows 111-Xc1 through 111-Xc3 have the same relative position, i.e. the 1st row. In FIG. 22, colorless areas having the same color as the color of the drawing sheet indicate an OFF state. FIG. 22 shows that the three rows 111-Xc1 through 111-Xc3 are displayed on the cabinet display 11-1.

The displayed positions of the rows 111-Xc1 through 111-Xc3 are sequentially changed by each row within an interval of twenty rows (see dotted arrows in FIG. 22) such that the displayed position of the row 111-Xc1 may descend down towards the last position just before the row 111-Xc2; the displayed position of the row 111-Xc2 may descend down towards the last position just before the row 111-Xc3; and the displayed position of the row 111-Xc3 may descend down towards the last row on the cabinet display 11-1. Specifically, the row 111-Xc1 is displayed and moved downward by each row within a range 500-1 from the first row to the twentieth row; the row 111-Xc2 is displayed and moved downward by each row within a range 500-2 from the twenty-first row to the fortieth row; the row 111-Xc3 is displayed and moved downward by each row within a range 500-3 from the forty-first row to the sixtieth row.

A display calibration system according to the fourth embodiment includes the display device 10*c* and the position detecting device 20*a* of the second embodiment. In the display calibration system of the fourth embodiment, an operator who conducts calibrations uses the position detecting device 20*a* of the second embodiment to detect positions of pixels. To detect the position of the pixel 111, similar to the second embodiment, an operator moves the position detecting device 20*a* close to the display 11*a* such that the pixel 111 will be covered by the opening 202 of the position detecting device 20*a*. For example, the detection timing of the pixel 111-40-50 can be set to the row-displaying timing of concurrently displaying 20th, 40th, and 60th rows on screen and the column-displaying timing of concurrently displaying 10th, 30th, and 50th columns on screen.

The positional information representing the twentieth row is superposed on the display signal for concurrently displaying 20th, 40th, and 60th rows on screen, while the positional information representing the tenth column is superposed on the display signal for concurrently displaying 10th, 30th, and 50th columns on screen.

For this reason, when an operator is moving the position detecting device 20*a* close to the display 11 such that the pixel 111-40-50 will be covered by the opening 202 of the position detecting device 20*a*, the output part 23*a* of the position detecting device 20*a* sequentially displays text messages on screen in an order of a text message "Cabinet: 1", a text message "Row: 20", and a text message "Column: 10".

The following descriptions are made on the condition that the entire screen of the cabinet display 11 is vertically divided into three row-related intervals (corresponding to the intervals 500-1 through 500-3 in FIG. 22) each including twenty rows and horizontally divided into three column-related intervals each including twenty columns.

An operator who moves the position detecting device 20*a* close to the display device 10*c* while watching the output part 23*a* of the position detecting device 20*a* relative to the display device 10*c* is able to predict in advance that the pixel 111-40-50 subjected to calibration may be positioned at a row around the boundary between the second and third row-related intervals and at a column around the center of the third column-related interval.

Considering the positional information regarding the pixel 111-40-50 to be positioned around the boundary of the second and third row-related intervals, an operation is able to predict further details as follows.

That is, when the output part 23*a* of the position detecting device 20*a* displays a relatively large row number ranging between "15" and "20", it is possible to determine that the opening 202 of the position detecting device 20*a* may be located in the latter part of the second row-related interval ranging, i.e. 21st to 40th rows. When the output part 23*a* of the position detecting device 20*a* displays a relatively small row number ranging from "1" to "5", it is possible to determine that the opening 202 of the position detecting device 20*a* may be located in the former half of the second row-related intervals, i.e. 41st to 60th rows.

Using the display device 10*c* of the fourth embodiment, an operator is able to determine that the pixel 111-40-50 exists in the cabinet display 11-1 corresponding to the cabinet number "1", wherein an operator is able to further determine that the pixel 111-40-50 is positioned at the twentieth row of the second row-related interval, i.e. 40th row and at the tenth column of the third column-related interval, i.e. 50th column.

The display device 10*c* of the fourth embodiment is designed to concurrently display rows/columns with a certain interval of rows/columns. Compared with the display device 10*a* of the second embodiment, the display device 10*c* of the fourth embodiment is configured to carry out calibration display operations for all the cabinet displays 11-1 through 11-4 in a short period of time. Considering a very large size of the cabinet displays 11-1 through 11-4, for example, it is possible to detect an accurate position of the pixel 111 in a short period of time using the display device 10*c* of the fourth embodiment rather than the display device 10*a* of the second embodiment.

It is possible to apply the configuration of the third embodiment to the configuration of the fourth embodiment such that multiple sets of consecutive rows are displayed with a certain interval of rows while multiple sets of consecutive columns are displayed with a certain interval of columns. This may further reduce a period of time for carrying out calibration display operations for rows and columns in all the cabinet displays 11-1 through 11-4. Accordingly, an operator may roughly detect an area for locating the pixel 111 subjected to calibration, and then, the configuration of the third embodiment (i.e. the display device 10*b*) is used to narrow down the area and to thereby carry out a calibration display operation; hence, it is possible to further reduce a period of time for detecting the position of the pixel 111 subjected to calibration.

The fourth embodiment adopts a certain interval of rows/columns, which is set to an interval of twenty rows/columns, in advance. However, it is possible to use an arbitrary interval of rows/columns, and therefore, it is possible to determine an appropriate interval of rows/columns depending on the number of pixels 111 included in each of the cabinet displays 11-1 through 11-4.

According to the fourth embodiment, the row selector 122*c* selects multiple rows with an interval of twenty rows. For this reason, when the number of rows applied to each of the cabinet displays 11-1 through 11-4 is not a multiple of twenty, the row selector 122*c* may not appropriately select multiple rows in the last interval of rows. In this case, the row selector 122*c* cannot select multiple rows subjected to a calibration display operation in the last interval of rows, and therefore, the display device 10*c* should abort a calibration display operation in the last interval of rows. Similarly, the column selector 123*c* selects multiple columns with an interval of twenty columns. When the number of columns applied to each of the cabinet displays 11-1 through 11-4 is not a multiple of twenty, the display device 10*c* should abort a calibration display operation in the last interval of columns.

5. Fifth Embodiment

Figure 23:
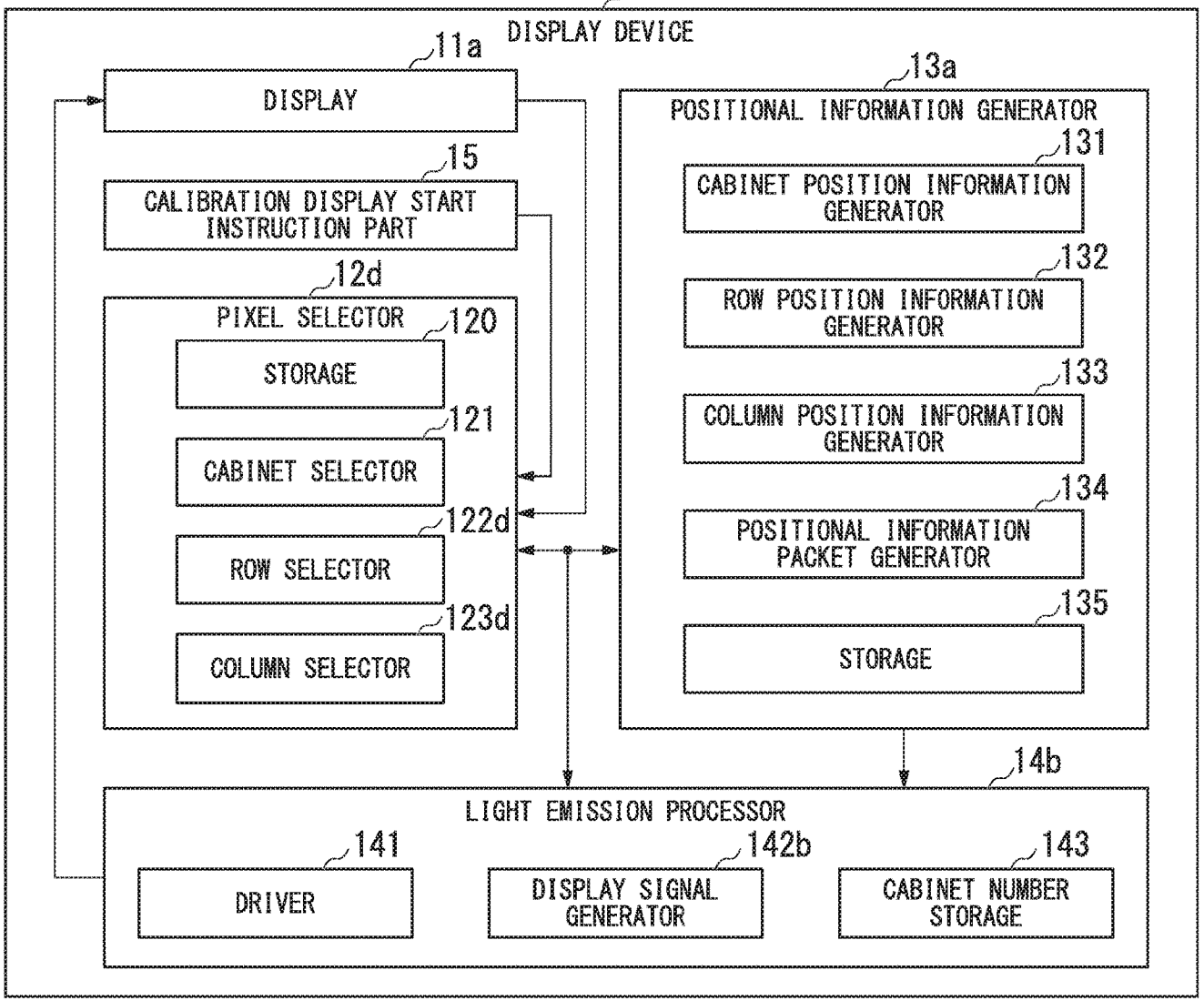
FIG. 23 is a block diagram of a display device according to the fifth embodiment of the present invention.

FIG. 23 is a block diagram of a display device 10*d* according to the fifth embodiment of the present invention. The display device 10*a* of the second embodiment carries out calibration display operations for each row and for each column, while the display device 10*b* of the third embodiment carries out calibration display operations for repeatedly displaying every three rows without overlapping other rows and for repeatedly displaying every three columns without overlapping other columns. In contrast, the display device 10*d* of the fifth embodiment is designed to carry out calibration display operations for repeatedly displaying every three rows with two rows partially overlapping the next three rows and for repeatedly displaying every three columns with two columns partially overlapping the next three columns.

Figure 25:
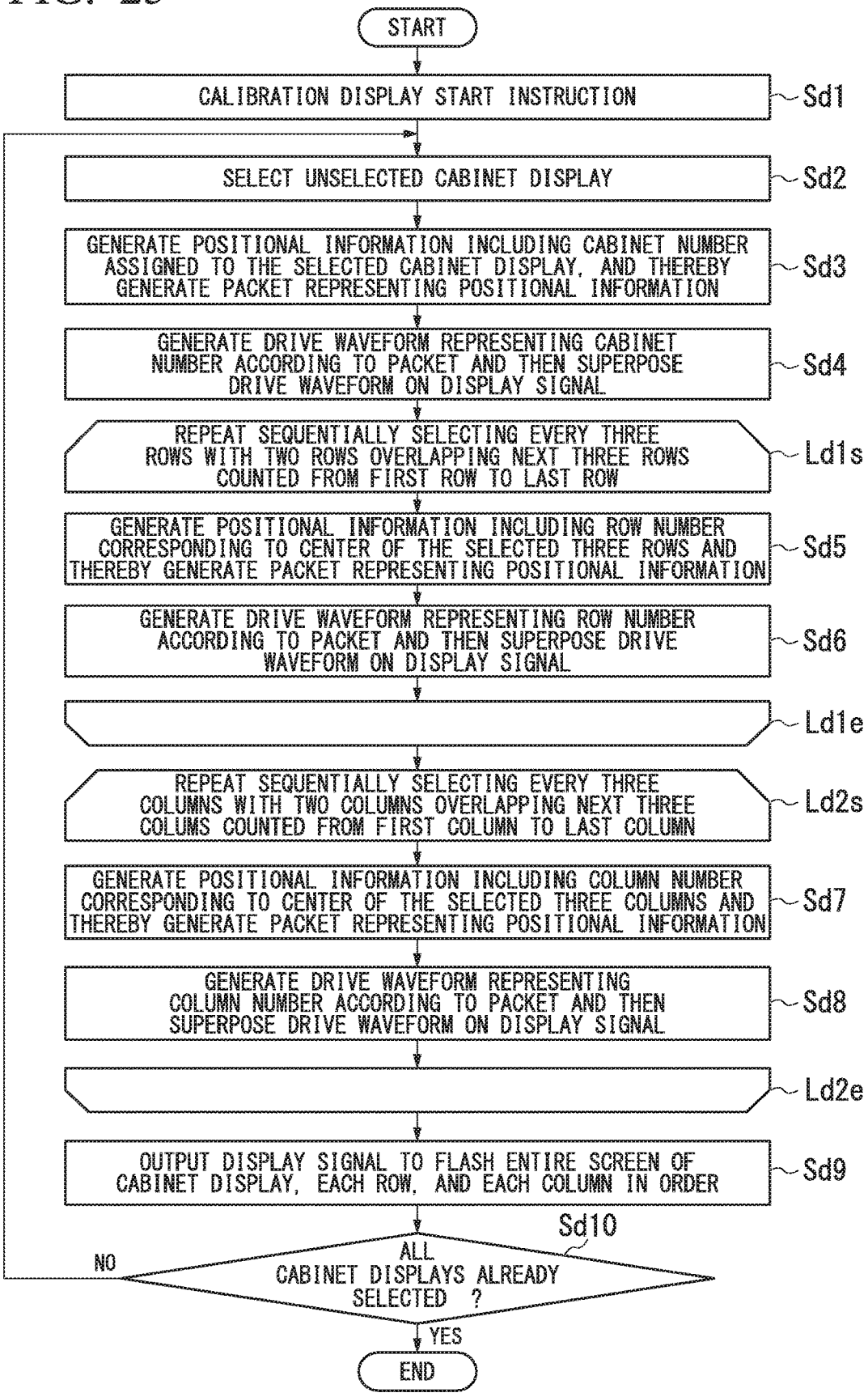
FIG. 25 is a flowchart showing a series of processes implemented by the display device of the fifth embodiment.

In FIG. 25, the parts identical to those of the display device 10*a* shown in FIG. 4 and those of the display device 10*b* shown in FIG. 17 are denoted using the same reference signs; hence, the following descriptions will refer to differences between the display device 10*d* and the display devices 10*a*, 10*b*. The display device 10*d* includes the display 11*a*, a pixel selector 12*d*, the positional information generator 13*a*, the light emission processor 14*b*, and the calibration display start instruction part 15.

The pixel selector 12*d* includes the storage 120, the cabinet selector 121, a row selector 122*d*, a column selector 123*d*. With reference to the storage 120, the row selector 122*d* of the pixel selector 12*d* selects every three rows with two rows overlapping the next three rows, counted from the first row to the last row, within a range of rows correlated to the cabinet number output from the cabinet selector 121. In addition, the row selector 122*d* sends the row numbers of the selected three rows to the light emission processor 14*b* while sending the row number corresponding to the center of the selected three rows to the positional information generator 13*a*.

With reference to the storage 120, the column selector 123*d* selects every three columns with two columns overlapping the next three columns, counted from the first column to the last column, within a range of columns correlated to the cabinet number output from the cabinet selector 121. In addition, the column selector 123*d* sends the column numbers of the selected three columns to the light emission processor 14*b* while sending the column number corresponding to the center of the selected three columns to the positional information generator 13*a*.

Figure 24:
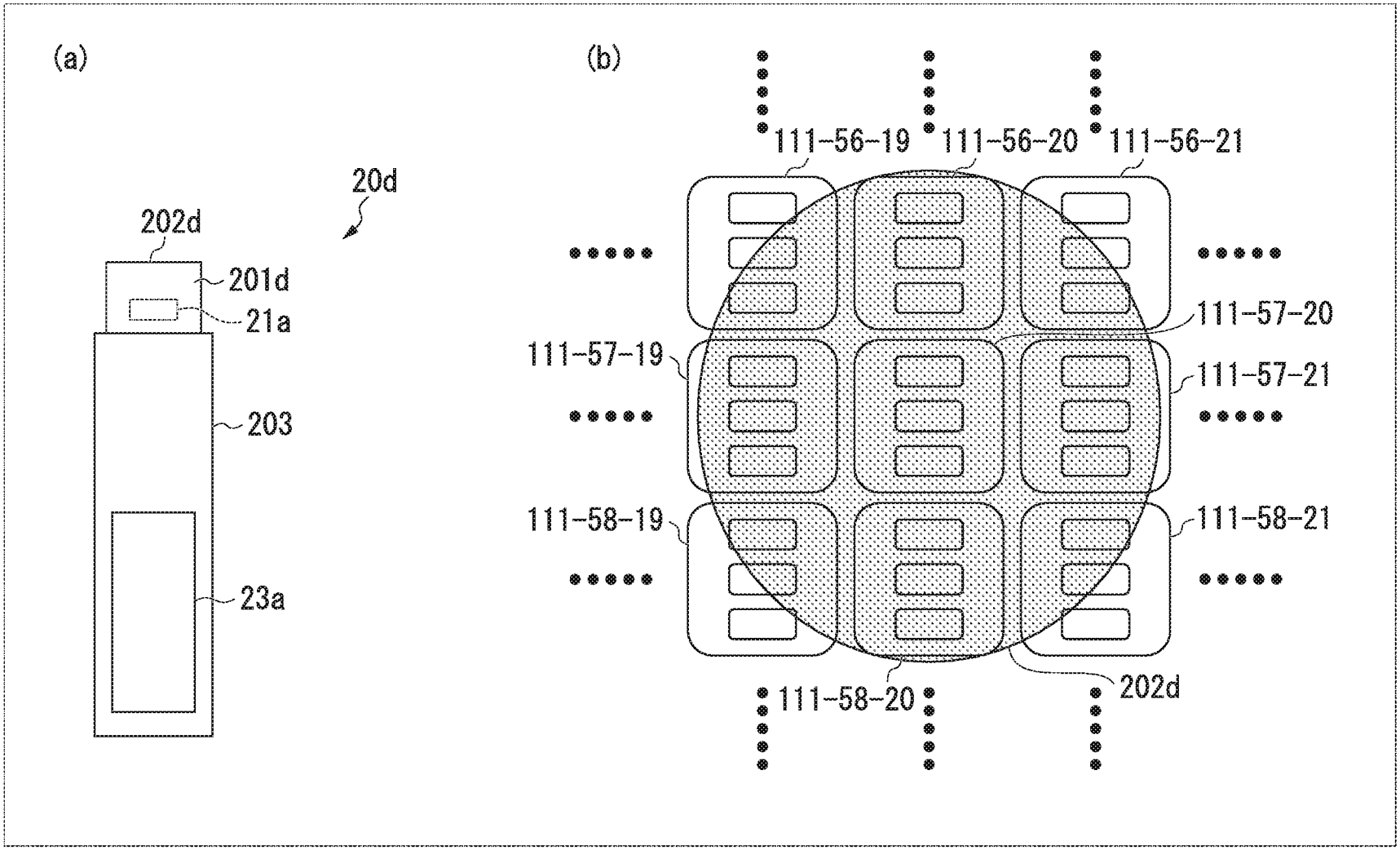
FIG. 24 shows an exterior appearance of a position detecting device according to the fifth embodiment and a positional relationship between an opening of the position detecting device and pixels on the display device.

FIG. 24 shows an exterior appearance of a position detecting device 20*d* and a size of an opening 202*d* of the position detecting device 20*d* according to the fifth embodiment. The position detecting device 20*d* has the same internal function and configuration as the position detecting device 20*a* shown in FIG. 8. The position detecting device 20*d* includes a distal end portion 201*d* having the larger opening 202*d* than the opening 202 of the position detecting device 20*a*.

The diameter of the opening 202*d* of the position detecting device 20*d* is about three times larger than the length of the pixel 111. As shown in FIG. 24(*b*), the opening 202*d* has an opening area able to cover three pixels 111 in both the horizontal direction and the vertical direction.

FIG. 25 is a flowchart showing a series of processes implemented by the display device 10*d* of the fifth embodiment. In FIG. 25, a series of steps Sd1 through Sd4 and Sd10 are identical to a series of steps Sa1 through Sa4 and Sa10 shown in FIG. 11; hence, the following descriptions refer to a series of steps following step Sd4.

With reference to the storage 120, the row selector 122*d* selects every three rows with two rows overlapping the next three rows, counted from the first row to the last row, within a range of rows correlated to the cabinet number output from the cabinet selector 121. In other words, the row selector 122*d* selects three rows of pixels and then shifts the three rows by one row. Specifically, the row selector 122*d* selects first to third rows at first, and then, the row selector 122*d* selects second to fourth rows.

The row selector 122*d* sends the row numbers of the selected three rows to the light emission processor 14*b* while sending the row number corresponding to the center of the selected three rows to the positional information generator 13*a*. Thereafter, the row position information generator 132 and the positional information packet generator 134 of the positional information generator 13*a* carry out step Sd5 identical to step Sb5 shown in FIG. 18 while the display signal generator 142*b* of the light emission processor 14*b* carries out step Sd6 identical to step Sb6 shown in FIG. 18.

The row selector 122*d*, the row position information generator 132, the positional information packet generator 134, and the display signal generator 142*b* cooperate together to repeatedly carry out a series of steps Sd5-Sd6 in an order from the first row to the last row in a loop Ld1*s*-Ld1*e*.

With reference to the storage 120, the column selector 123*d* selects every three columns with two columns overlapping the next three columns, counted from the first column to the last column, within a range of columns correlated to the cabinet number output from the cabinet selector 121. In other words, the column selector 123*d* selects three columns of pixels and then shifts the three columns by one column. Specifically, the column selector 123*d* selects first to third columns at first, and then, the column selector 123*d* selects second to fourth columns.

The column selector 123*d* sends the column numbers of the selected three columns to the light emission processor 14*b* while sending the column number corresponding to the center of the selected three columns to the positional information generator 13*a*. Thereafter, the column position information generator 133 and the positional information packet generator 134 of the positional information generator 13*a* carry out step Sd7 identical to step Sb7 shown in FIG. 18 while the display signal generator 142*b* of the light emission processor 14*b* carries out step Sd8 identical to step Sb8 shown in FIG. 18.

The column selector 123*d*, the column position information generator 133, the positional information packet generator 134, and the display signal generator 142*b* cooperate together to carry out a series of steps Sd7-Sd8 in an order from the first column to the last column in a loop Ld2*s*-Ld2*e*.

Upon inputting the display signal superposed with the drive waveform output from the display signal generator 142*b*, the driver 141 sends the display signal to the display 11*a*. Upon inputting the display signal, the display 11*a* flashes the entire screen of each of the cabinet displays 11-1 through 11-4 in white, which is selected by the cabinet selector 121 in step Sd2, and then, the display 11*a* flashes multiple rows and multiple columns in white in step Sd9.

The display 11*a* firstly displays first to third rows on the cabinet display 11-1, and then, the display device 11*a* displays second to fourth rows, thereafter, third to fifth rows on screen.

A display calibration system of the fifth embodiment includes the display device 10*d* and the position detecting device 20*d*. That is, an operator is able to detect the position of the "nonluminous" pixel 111 not emitting light by applying the position detecting device 20*d* to the display device 10*d* according to the fifth embodiment. When an operator finds a "nonluminous" pixel 111-57-20 by viewing the cabinet display 11-1 as shown in FIG. 26, the operator moves the position detecting device 20*d* close to the cabinet display 11-1 such that the opening 202*d* will cover an area about the nonluminous pixel 111-57-20 as shown in FIG. 26(*b*).

After starting a calibration display operation using the display device 10*d*, the output part 23*a* of the position detecting device 20*d* displays a text message "Cabinet: 1" at first. When a row segment 111-Xd1 corresponding to 55th to 57th rows is displayed on the cabinet display 11-1, the output part 23*a* of the position detecting device 20*d* displays a text message "Row: 56" corresponding to the center row number "56" among three row numbers "55" through "57" included in the row segment 111-Xd1.

Figure 26:
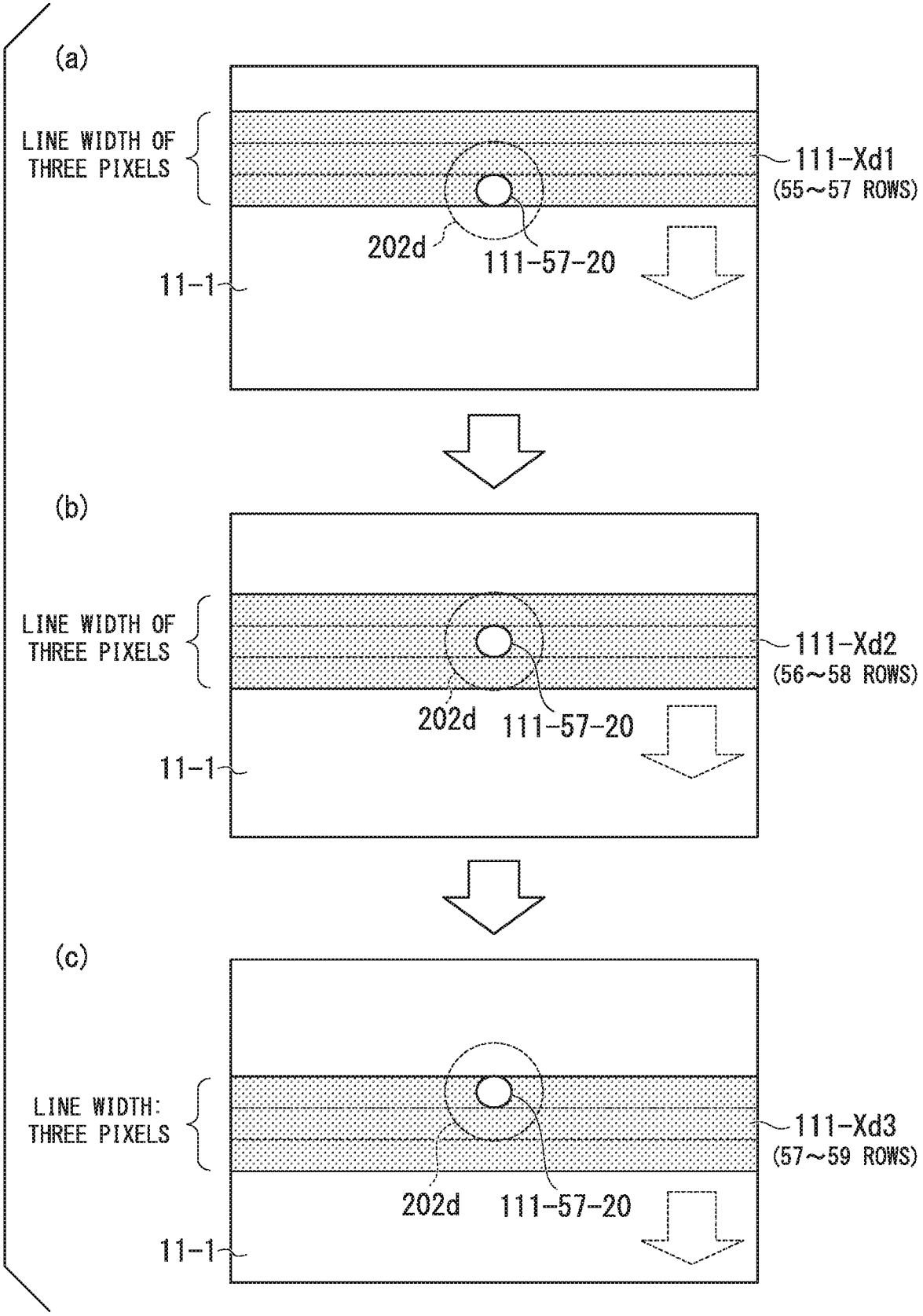
FIG. 26 shows display calibration operations for displaying and shifting multiple rows with two rows overlapping the next three rows on screen.

When a row segment 111-Xd2 corresponding to 56th to 58th rows is displayed on the cabinet display 11-1 as shown in FIG. 26(*b*), the output part 23*a* of the position detecting device 20*d* displays a text message "Row: 57" corresponding to the center row number "57" among three row numbers "56" to "58" included in the row segment 111-Xd2.

When a row segment 111-Xd3 corresponding to 57th to 59th rows is displayed on the cabinet display 11-1 as shown in FIG. 26(*c*), the output part 23*a* of the position detecting device 20*d* displays a text message "Row: 58" corresponding to the center row number "58" among three row numbers "57" to "59" included in the row segment 111-Xd3.

Upon viewing the center row number "57" among three row numbers "56", "57", and "58", an operator may detect the position of the nonluminous pixel 111-57-20 as the row number "57". Similar operations are made with respect to columns, and therefore, an operator may detect the position of the nonluminous pixel 111-57-20 as the column number "20".

Figure 27:
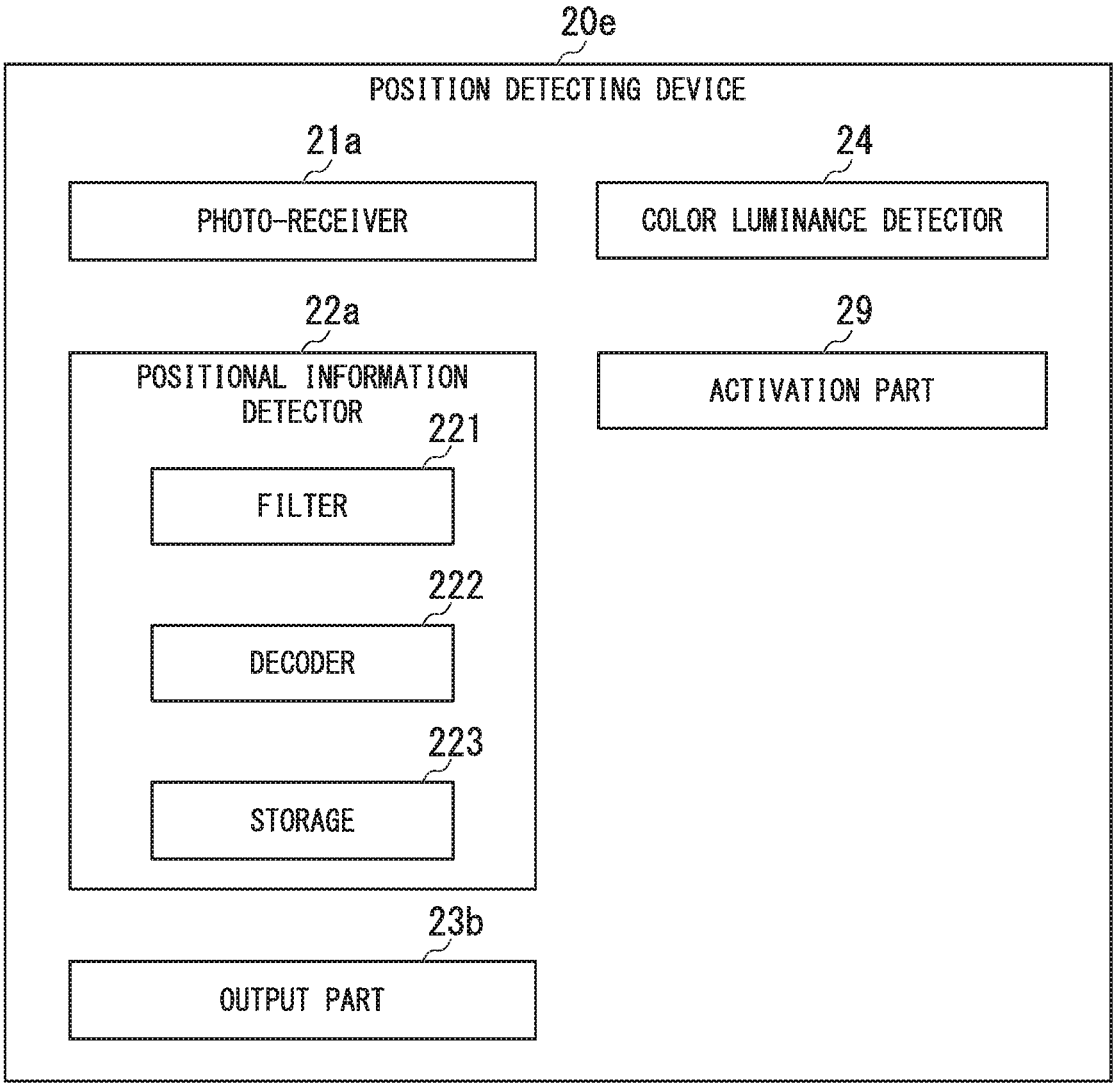
FIG. 27 is a block diagram showing a variation of a position detecting device.

The first to fifth embodiments are designed such that, after detecting the position of the pixel subjected to calibration using the position detecting devices 20, 20*a*, and 20*d*, an operator may adjust a balance of luminance by viewing the luminance of the pixel with his/her eyes; however, the present invention is not necessarily limited to the foregoing embodiments. FIG. 27 is a block diagram of a position detecting device 20*e* which is configured to add a color luminance detector 24 to the configuration of the position detecting device 20*a* shown in FIG. 8 while replacing the output part 23*a* with an output part 23*b*. Using the color luminance detector 24, it is possible to further detect an amount of luminance at the pixel while detecting the position of the pixel. Based on the amount of luminance detected by the color luminance detector 24 or based on both the amount of luminance and the luminance viewed by operator's eyes, it is possible to adjust a balance of luminance at the pixel subjected to calibration on the display devices 10, 10*a*, 10*b*, 10*c*, and 10*d*.

The second to fifth embodiments are designed to carry out a calibration display operation for depicting the entire screen, rows, and columns in white; but the present invention is not necessarily limited to those embodiments. When the luminance of pixels having LEDs does not match the sensitivity of the photo-receivers 21, 21*a* included in the position detecting devices 20, 20*d*, and 20*e*, it is possible to change the level of luminance and to thereby carry out a calibration display operation for depicting the entire screen, rows, and columns in grey or in another color. Alternatively, it is possible to adjust the luminance of pixels having LEDs to the sensitivity of the photo-receivers 21, 21*a* by attaching an optical dimming filter (or a light-attenuating filter) or an automatic gain adjustment circuit (or an electrical gain adjusting circuit) to the photo-receivers 21, 21*a* included in the position detecting devices 20, 20*d*, and 20*e*.

The second to fifth embodiments use pixels 111 configured of LEDs, however, it is possible to use other light-emitting elements such as organic electroluminescence elements other than LEDs.

In the second to fifth embodiments, the display 11*a* may include a plurality of cabinet displays, the number of which can be arbitrarily determined; however, the display 11*a* may include a single cabinet. The display 11*a* having a single cabinet display may eliminate the necessity of carrying out calibration display operations for all the cabinet displays 11-1 through 11-4 in the display devices 10*a*, 10*b*, 10*c*, and 10*d* according to the second to fifth embodiments. In addition, it is unnecessary to provide a decoding function to identify the cabinet type in the position detecting devices 20*a*, 20*d*, and 20*e*.

In the second to fifth embodiments, the display devices 10*a*, 10*b*, 10*c*, and 10*d* are each designed to align the pixels 111 in a matrix; however, the pixels 111 can be aligned in other shapes other than a matrix shape. In addition, those display devices are each designed to start a calibration display operation at the first row or at the first column; however, it is possible to start a calibration display operation in a random order. Moreover, those display devices are each designed to display each column after displaying each row; however, it is possible to randomly set an order between rows and columns subjected to calibration display operations.

In the display device 10*a* of the second embodiment, all the functional parts other than the display 11*a*, i.e. the pixel selector 12*a*, the positional information generator 13*a*, the light emission processor 14*a*, and the calibration display start instruction part 15, may be installed in an unillustrated controller of the display device 10*a* in FIGS. 3-4. The controller has a function to adjust a balance of luminance for the pixel 111 of the display 11*a* upon receiving an operator's operation. It may be efficient to design the configuration of the display device 10*a* by incorporating those functions into the controller. This design scheme of the second embodiment can be similarly applied to the third to fifth embodiments, wherein it is efficient to design the configuration of the display devices 10*b*, 10*c*, and 10*d* by incorporating all the functional parts other than the display 11*a* into the controller.

In the foregoing embodiments, the functions of the display devices 10, 10*a*, 10*b*, 10*c*, and 10*d* and the functions of the position detecting devices 20, 20*a*, 20*d*, and 20*e* can be realized using computers. In this case, it is possible to store computer programs achieving the foregoing functions on computer-readable storage media, and then, computer systems may load and execute computer programs stored on storage media and thereby achieve the foregoing functions. Herein, the term "computer system" may include software such as an OS and hardware such as peripheral devices. The term "computer-readable storage media" may refer to flexible disks, magneto-optical disks, ROM, portable media such as CD-ROM, and storage units such as hard-disk drives embedded in computer systems. In addition, the term "computer-readable storage media" may include any measures to dynamically hold programs in a short period of time such as networks like the Internet and communication lines like telephone lines used to transmit programs as well as any memories for holding programs for a certain period of time such as non-volatile memories inside computer systems acting as servers or clients. The computer programs may achieve part of the foregoing functions, or they may be combined with pre-installed programs of computer systems to achieve the foregoing functions. Alternatively, the computer programs may be achieved using programmable logic devices such as FPGA (Field Programmable Gate Array).

Lastly, the present invention is not necessarily limited to the foregoing embodiments and variations which are illustrative and not restrictive; hence, the present invention may embrace any modifications and changes of design within the scope of the invention as defined in the appended claims.

What is claimed is:

1. A display device comprising:

a display including a plurality of pixels having a plurality of light-emitting elements;

a pixel selector configured to select a pixel from among the plurality of pixels;

a positional information generator configured to generate positional information representing a position of the pixel selected by the pixel selector; and a light emission processor configured to superpose the positional information on light emitted by the pixel selected by the pixel selector, wherein the plurality of pixels are aligned in a matrix including rows and columns, wherein the pixel selector selects a row of pixels or a column of pixels within the matrix for aligning the plurality of pixels, wherein the positional information generator generates row positional information corresponding to the row of pixels selected by the pixel selector or column position information corresponding to the column of pixels selected by the pixel selector, and wherein the light emission processor superposes the row position information on light emitted by the row of pixels selected by the pixel selector or the light emission processor superposes the column position information on light emitted by the column of pixels selected by the pixel selector.

2. The display device according to claim 1, wherein the pixel selector selects multiple rows of pixels consecutively aligned together with/without an interval of rows or the pixel selector selects multiple columns of pixels consecutively aligned together with/without an interval of columns.

3. A display device comprising:

a display including a plurality of pixels having a plurality of light-emitting elements;

a pixel selector configured to select a pixel from among the plurality of pixels;

a positional information generator configured to generate positional information representing a position of the pixel selected by the pixel selector; and a light emission processor configured to superpose the positional information on light emitted by the pixel selected by the pixel selector, wherein the pixel selector selects the pixel for each cabinet among the plurality of cabinets, wherein the positional information generator generates cabinet position information representing each cabinet for locating the pixel selected by the pixel selector, and wherein the light emission processor superposes the cabinet position information on the light emitted by the pixel selected by the pixel selector.

4. A display calibration system comprising a display device and a position detecting device, wherein the display device comprises a display including a plurality of pixels having a plurality of light-emitting elements, a pixel selector configured to select a pixel from among the plurality of pixels, a positional information generator configured to generate positional information representing a position of the pixel selected by the pixel selector, and a light emission processor configured to superpose the positional information on light emitted by the pixel selected by the pixel selector, wherein the position detecting device comprises a photo-receiver configured to receive the light emitted by the pixel on the display device and to thereby convert the light into an electric signal, a positional information detector configured to detect the positional information superposed on the light of the pixel from the electric signal, and an output part configured to output the positional information detected by the positional information detector, wherein the plurality of pixels on the display device are aligned in a matrix including rows and columns, wherein the pixel selector selects a row of pixels or a column of pixels within the matrix for aligning the plurality of pixels, wherein the positional information generator generates row positional information corresponding to the row of pixels selected by the pixel selector or column position information corresponding to the column of pixels selected by the pixel selector, and wherein the light emission processor superposes the row position information on the light emitted by the row of pixels selected by the pixel selector or the light emission processor superposes the column position information on the light emitted by the column of pixels selected by the pixel selector.

5. The display calibration system according to claim 4, wherein the photo-receiver of the position detecting device receives the light emitted by the row of pixels or the column of pixels and thereby converting the light into an electric signal, wherein the positional information detector of the position detecting device detects the row position information or the column position information from the electric signal, and wherein the output part of the position detecting device outputs the row position information or the column position information.

6. A display method adapted to a display device including a plurality of pixels having a plurality of light-emitting elements, comprising:

selecting a pixel from among the plurality of pixels on the display device;

generating positional information representing a position of a selected pixel;

superposing the positional information on the light emitted by the selected pixel;

selecting a row of pixels or a column of pixels within a matrix for aligning the plurality of pixels on the display device;

generating row positional information corresponding to the row of pixels or column position information corresponding to the column of pixels; and superposing the row position information on light emitted by the row of pixels or superposing the column position information on light emitted by the column of pixels.

7. A position detecting method adapted to a display device including a plurality of pixels having a plurality of light-emitting elements in which the display device is configured to select a pixel from among the plurality of pixels and to thereby superpose positional information of a selected pixel on light emitted by the selected pixel, comprising:

receiving the light emitted by the selected pixel on the display device and to thereby covert the light into an electric signal;

detecting the positional information superposed on the light of the selected pixel from the electric signal; and outputting the positional information, wherein the display device is configured to select a row of pixels or a column of pixels from among the plurality of pixels and to thereby superpose row position information corresponding to the row of pixels on light emitted by the row of pixels or to thereby superpose column position information corresponding to the column of pixels on light emitted by the column of pixels.

8. The position detecting method according to claim 7, further comprising:

receiving the light emitted by the row of pixels or the light emitted by the column of pixels and to thereby convert the light into an electric signal;

detecting the row position information or the column position information from the electric signal; and outputting the row position information or the column position information.

9. A display calibration method adapted to a display calibration system comprising a display device and a position detecting device in which the display device includes a plurality of pixels having a plurality of light-emitting elements, comprising:

selecting, by the display device, a pixel from among the plurality of pixels;

generating, by the display device, positional information representing a position of a selected pixel;

superposing, by the display device, the positional information on light emitted by the selected pixel;

receiving, by the position detecting device, the light emitted by the selected pixel on the display device and thereby converting the light into an electric signal;

detecting the positional information superposed on the light of the selected pixel from the electric signal; and outputting the positional information, wherein the plurality of pixels on the display device are aligned in a matrix including rows and columns, the method further comprising:

selecting, by the display device, a row of pixels or a column of pixels within the matrix for aligning the plurality of pixels;

generating, by the display device, row positional information corresponding to the row of pixels or column position information corresponding to the column of pixels;

superposing, by the display device, the row position information on the light emitted by the row of pixels or superposing the column position information on the light emitted by the column of pixels.

10. The display calibration method according to claim 9, wherein the plurality of pixels on the display device are aligned in a matrix including rows and columns, the method further comprising:

receiving, by the position device, the light emitted by the row of pixels or the column of pixels and thereby converting the light into an electric signal;

detecting, by the position detecting device, the row position information or the column position information from the electric signal, and outputting, by the position detecting device, the row position information or the column position information.

* * * * *